US011937761B2

(12) United States Patent
Cheung et al.

(10) Patent No.: US 11,937,761 B2
(45) Date of Patent: Mar. 26, 2024

(54) ATTACHMENT FOR A VACUUM CLEANING APPLIANCE

(71) Applicant: Dyson Technology Limited, Wiltshire (GB)

(72) Inventors: Ying Yeung Cheung, Bristol (GB); Stephen Robert Dimbylow, Swindon (GB); James White, Swindon (GB); Robert Hinchliffe, Bristol (GB)

(73) Assignee: Dyson Technology Limited, Wiltshire (GB)

( * ) Notice: Subject to any disclaimer, the term of this patent is extended or adjusted under 35 U.S.C. 154(b) by 42 days.

(21) Appl. No.: 17/641,399

(22) PCT Filed: Aug. 19, 2020

(86) PCT No.: PCT/GB2020/051981
§ 371 (c)(1),
(2) Date: Mar. 8, 2022

(87) PCT Pub. No.: WO2021/048521
PCT Pub. Date: Mar. 18, 2021

(65) Prior Publication Data

US 2022/0296060 A1 Sep. 22, 2022

(30) Foreign Application Priority Data

Sep. 11, 2019 (GB) ..... 1913106

(51) Int. Cl.
*A47L 9/06* (2006.01)
*A47L 5/30* (2006.01)
*A47L 9/24* (2006.01)

(52) U.S. Cl.
CPC ..... *A47L 9/0606* (2013.01); *A47L 5/30* (2013.01); *A47L 9/246* (2013.01); *A47L 9/248* (2013.01)

(58) Field of Classification Search
CPC ..... A47L 9/0606; A47L 5/30; A47L 9/246; A47L 9/248; A47L 5/26; A47L 9/06;
(Continued)

(56) References Cited

U.S. PATENT DOCUMENTS 3,259,934 A 7/1966 Leinfelt
2003/0217433 A1 11/2003 Albert et al.
(Continued)

FOREIGN PATENT DOCUMENTS

AT 402682 B 7/1997
CN 101731995 A 6/2010
(Continued)

OTHER PUBLICATIONS

International Search Report and Written Opinion received for PCT Patent Application No. PCT/GB2020/051981, dated Nov. 23, 2020, 9 pages.
(Continued)

*Primary Examiner* — Eric J Rosen
*Assistant Examiner* — Tyler James McFarland
(74) *Attorney, Agent, or Firm* — Faegre Drinker Biddle & Reath LLP

(57) ABSTRACT

An attachment for a vacuum cleaning appliance has a first part which is connectable to a main body of the appliance, and a second part which is connectable to the first part. The first part includes a crevice nozzle and a brush section which is moveable along the crevice nozzle between a retracted position and a deployed position. The second part includes a suction inlet, and is arranged to be push-fitted over the first part so that the crevice nozzle and the brush section of the first part are both stored within the second part when the second part is connected to the first part.

20 Claims, 26 Drawing Sheets

(58) Field of Classification Search
CPC ..... A47L 9/0633; A47L 9/0673; A47L 9/242; A47L 5/24; A47L 9/02; A47L 9/24; A47L 9/0693
See application file for complete search history.

(56) References Cited

U.S. PATENT DOCUMENTS

| | | | | |
|---|---|---|---|---|
| 2004/0045127 | A1 | 3/2004 | Albert et al. | |
| 2014/0338148 | A1* | 11/2014 | Lee | A47L 7/0014 15/400 |

FOREIGN PATENT DOCUMENTS

| | | | |
|---|---|---|---|
| CN | 202437016 | U | 9/2012 |
| CN | 109893027 | A | 6/2019 |
| DE | 102008055043 | A1 | 8/2010 |
| DE | 202011108260 | U1 | 2/2012 |
| EP | 1025791 | B1 | 9/2003 |
| EP | 2805661 | A1 | 11/2014 |
| EP | 3412185 | A1 | 12/2018 |
| GB | 2223934 | A | 4/1990 |
| GB | 2477302 | A | 8/2011 |
| GB | 2569820 | A | 7/2019 |
| JP | 06-048555 | U | 7/1994 |
| JP | 06-311948 | A | 11/1994 |
| JP | 10-118592 | A | 5/1998 |
| JP | 11-047045 | A | 2/1999 |
| JP | 11-151185 | A | 6/1999 |
| JP | 2000-229052 | A | 8/2000 |
| JP | 2004-121879 | A | 4/2004 |
| JP | 2005-160556 | A | 6/2005 |
| JP | 2005-329009 | A | 12/2005 |
| JP | 2006-239222 | A | 9/2006 |
| JP | 3128401 | U | 1/2007 |
| JP | 2007-021057 | A | 2/2007 |
| JP | 2007-144005 | A | 6/2007 |
| JP | 5901330 | B2 | 4/2016 |
| JP | 2016-150234 | A | 8/2016 |
| WO | 02/67748 | A1 | 9/2002 |
| WO | 2011/092484 | A1 | 8/2011 |

OTHER PUBLICATIONS

Search report received for Great Britain Patent Application No. 1913106.9, dated Feb. 25, 2020, 1 page.
Office Action received for Chinese Patent Application No. 202080064368.8, dated Oct. 14, 2022, 22 pages (14 pages of English Translation and 8 pages of Original Document).
Office Action received for Japanese Patent Application No. 2022-515987, dated Jun. 6, 2023, 7 pages (4 pages of English Translation and 3 pages of Original Document).

* cited by examiner

ATTACHMENT FOR A VACUUM CLEANING APPLIANCE

CROSS-REFERENCE TO PRIOR APPLICATION

This application is a § 371 National Stage Application of PCT International Application No. PCT/GB2020/051981 filed Aug. 19, 2020, which claims the priority of United Kingdom Application No. 1913106.9, filed Sep. 11, 2019, each of which are herein incorporated by reference in their entirety.

FIELD OF THE INVENTION

The present invention relates to an attachment for a vacuum cleaning appliance. The attachment is preferably in the form of a wand assembly, and finds particularly use in a handheld, or stick, vacuum cleaner which includes a wand assembly extending between a main body and an auxiliary suction tool, but may also be used on a cylinder, or canister, vacuum cleaner in which a hose is located between the main body and the wand assembly. Alternatively, the attachment may be in the form of a two-part suction tool for a vacuum cleaning appliance.

BACKGROUND OF THE INVENTION

In a typical vacuum cleaning appliance, such as the Dyson V11™ vacuum cleaner, a main body of the appliance is fluidly connected to a floor tool via a wand assembly. During a floor cleaning mode of operation of the appliance, a user grasps a handle provided on the main body to manoeuvre the floor tool across the floor.

In certain situations, it is convenient to switch the operational mode of the appliance to a handheld mode through interchanging the wand assembly and floor tool for a different suction tool. For example, the user may attach to the main body a crevice tool which provides a relatively narrow suction inlet, or a brushed tool which agitates dust and other debris from a work surface for entrainment within the airflow entering the appliance. These auxiliary suction tools are ordinarily sold with the vacuum cleaner as separate accessories for interchange with the wand assembly and floor tool as and when desired.

The problem with providing auxiliary suction tools as separate accessories is that the user may temporarily misplace a given tool, or possibly lose the tool altogether. Furthermore, the act of detaching the wand assembly from the main body and reattaching an auxiliary suction tool can be time consuming for a user, which can detract from a user changing the mode of use of the appliance a number of times during the cleaning of a room.

SUMMARY OF THE INVENTION

In a first aspect, the present invention provides an attachment for a vacuum cleaning appliance, the attachment comprising:

- a first part comprising a crevice nozzle, a brush section which is moveable relative to the crevice nozzle between a retracted position and a deployed position, and a first connector for releasably connecting the first part to a body of the appliance; and
- a second part comprising a suction inlet and a second connector for releasably connecting the second part to the first part, and wherein the second part is arranged to be push-fitted over the first part so that the crevice nozzle and the brush section are stored within the second part when the second part is connected to the first part.

The attachment may be in the form of a wand assembly, in which the second part comprises a wand having a suction inlet which is connectable to an auxiliary suction tool, such as a floor tool, a dusting brush or a mattress cleaning tool.

The present invention may thus provide a two part attachment which enables a vacuum cleaning appliance to be used in different cleaning modes depending on which parts of the attachment are connected to a main body of the appliance. When the first part only is connected to the main body, the appliance can be used in a "handheld mode" of operation for cleaning surfaces raised from a floor surface, such as the surfaces of furniture or a car. When in this mode of operation, moving the brush section between its retracted position and its deployed position can enable the user to rapidly change between a "crevice mode", in which the crevice nozzle can inserted between gaps in furniture and the like during cleaning, and a "brush mode", in which bristles of the brush section can agitate dust and debris from exposed work surfaces to become entrained in the airflow entering the crevice nozzle, respectively without having to replace the first part with a different suction tool. When the second part of the attachment is also connected to the body of the appliance, the appliance can be used in a "floor cleaning" mode of operation, in which a floor tool, attachable to the suction inlet of the second part, is manoeuvred over a floor surface by a user.

The user may thus change between a handheld mode of operation of the appliance and a floor cleaning mode of operation of the appliance through either disconnecting the second part of the attachment from the body, through actuating the second connector and pulling the second part from the first part, or through reconnecting the second part to the body. If desired, a floor tool or other auxiliary suction tool may remain attached to the suction inlet of the second part as the second part is disconnected from, and reconnected to, the first part. Compared to an appliance in which the user has to disconnect a wand from the appliance before attaching an auxiliary suction tool, or vice versa, this can halve the number of user actions required to place the appliance in the desired operational mode.

The second part is arranged so that the crevice tool and the brush section are both stored within the second part when it is connected to the body of the appliance. This inhibits damage to the crevice tool, and in particular to the brush section, when not in use.

The second connector connects the second part to the first part when it is pushed over the first part. This can enable the second connector to be spaced from the first connector to reduce the risk of accidental release of the first part from the body of the appliance when a user intends to disconnect the second part from the first part. This can also enable the entire attachment, or wand assembly, to be detached from the body through disconnecting the first part from the body, and enable the first part to be stored within the second part when the attachment is not in use. The second connector preferably comprises a catch which engages a recess formed on the first part, preferably the crevice nozzle of the first part, depending on the relative positions between the first part and the second part.

The brush section preferably extends at least partially about, and preferably surrounds, the crevice nozzle. The brush section is preferably moved along the crevice nozzle, preferably in a linear direction, between its retracted position and its deployed position. The crevice nozzle preferably comprises a front section, a suction inlet located at a front end of the front section, and a rear section. The first connector is preferably located on or adjacent the rear section of the crevice nozzle. The brush section preferably comprises a plurality of bristles, which are preferably arranged at least partially about the crevice nozzle. The bristles are preferably arranged in a plurality of bristle tufts, although the bristles may be arranged in a continuous array or in a discontinuous array. The bristles are preferably mounted on a brush collar which surrounds the crevice nozzle, and which is moveable relative to the crevice nozzle. When the brush section is in its deployed position, at least the free ends, or tips, of the bristles preferably protrude forwardly beyond the front end of the crevice nozzle.

The brush section preferably comprises a bristle sleeve which extends about the bristles. The bristle sleeve has a free end, and is arranged such that the free ends of the bristles protrude forwardly beyond the free end of the bristle sleeve. Preferably, no more than 20% of the length of the bristles, more preferably no more than 10% of the length of the bristles, protrudes beyond the free end of the bristle sleeve. The provision of the bristle sleeve reduces the risk of the bristles splaying as the brush section is inserted into the second part during connection of the second part to the first part. The bristle sleeve is preferably formed from a resiliently deformable material, preferably from a polyurethane plastic such as TPU, or silicone. Optionally, a second bristle sleeve may be provided around the aforementioned bristle sleeve. Each bristle sleeve may be formed from the same material, such as TPU. Alternatively, one of the bristle sleeves, for example, the second bristle sleeve, may be formed from stiffer material than the other bristle sleeve. Apertures may be formed in the bristle sleeve(s). These apertures can provide air bleeds for permitting air to enter the crevice nozzle from between the bristle tufts.

The first part preferably comprises means for retaining the brush section in its deployed position. In a preferred embodiment, the retaining means comprises a retention catch, preferably in the form of a finger, which engages a recess formed in the crevice nozzle to retain the brush section in its deployed position. The brush section preferably comprises means for urging the retention catch to engage with the recess when the brush section is in its deployed position. The urging means is preferably provided by a resilient element, such as a spring. To release the brush section from its deployed position, the user actuates the retention catch to disengage it from the recess, against the biasing force of the spring. The user may then simultaneously move the brush section away from its deployed position. The retention catch is preferably shaped so as to protrude outwardly from the outer surface of the brush section when the brush section is retained in its deployed position. In this case, the user may press inwardly the protruding portion of the retention catch to disengage the retention catch from the recess.

When the brush section is in its retracted position, the brush section is preferably positioned around or adjacent the rear section of the crevice nozzle to expose the front section of the crevice nozzle for insertion into gaps between items of furniture.

The second part of the attachment is preferably arranged to store the crevice nozzle and the brush section of the first part with the brush section disposed in its retracted position. In a preferred embodiment, the second part comprises a neck located at one end of the second part, with the suction inlet being located at the other end of the second part. The neck is preferably arranged to receive at least the brush section of the first part, more preferably both the crevice nozzle and the brush section of the first part. The neck preferably comprises a relatively wide internal section for receiving the brush section, and a relatively narrow internal section, located upstream from the relatively wide internal section, for receiving the front section of the crevice nozzle. The neck preferably comprises the second connector for releasably connecting the second part to the first part.

The second part, preferably the neck of the second part, is preferably arranged to engage the brush section to move it towards its deployed position as the second part is pulled from the first part to detach the second part from the first part. The neck is preferably shaped to form an interference fit with the brush section when the brush section is stored within the second part. As the second part is pulled from the first part, the mechanical interaction between the brush section and the neck cause the brush section to move with the neck, so effecting movement of the brush section away from its retracted position The first part preferably comprises means for inhibiting movement of the brush section beyond its deployed position. In a preferred embodiment, the brush section comprises a pawl which is biased towards the external surface of the crevice nozzle, and which enters a channel or groove formed in the crevice nozzle as the brush section moves towards its deployed position. When the brush section has moved to its deployed position, the pawl is located at the end of the channel, which inhibits further movement of the brush section beyond the deployed position. Increasing the force with which the second part is pulled away from the first part overcomes the mechanical interaction between the neck and the brush section to enable the second part to be fully released from the first part.

The neck is preferably shaped to engage the retention catch when the brush section is stored within the neck. The engagement between the neck and the retention catch urges the retention catch inwards to disengage it from the recess, and so permit relative movement between the brush section and the crevice nozzle whilst retaining the brush section within the neck. As the user pulls the second part from the first part, the neck releases the retention catch, enabling it to move under the action of the biasing force of the spring to engage the recess and so retain the brush section in its deployed position.

In the event that the second part is reconnected to the first part whilst the brush section is retained in its deployed position, the neck of the second part engages the retention catch as the second part is pushed over the first part to locate the brush section within the relatively wide portion of the neck. This engagement releases the brush section from its deployed position. The interference fit so generated between the brush section and the neck retains the brush section in the relatively wide portion of the neck. As the second part is pushed further over the first part, relative movement is effected between the brush section and the crevice nozzle, resulting in the crevice nozzle entering the relatively narrow portion of the neck. Once the second part has been pushed fully over the first part, the brush section is disposed in its retracted position relative to the crevice nozzle, and the second part is connected to the first part by the second connector.

The first part includes a first guide mechanism for guiding movement of the brush section away from its retracted position, and a second guide mechanism for guiding movement of the brush section into its deployed position. The second guide mechanism is preferably different from the first guide mechanism. The second guide mechanism is provided by the aforementioned pawl located on the brush section and the channel located on the crevice nozzle which the pawl enters as the brush section moves towards its deployed position. The first guide mechanism comprises a plurality of rails located on the crevice nozzle, and a plurality of channels located on the brush section. The channels receive the rails as the brush section moves from its deployed position towards its retracted position. The channel is preferably axially spaced from the rails, more preferably both axially and angularly spaced from the rails, so that the pawl does not engage with the rails as the brush section moves between its retracted position and its deployed position.

The crevice nozzle preferably comprises an annular mating surface for engaging a seal of the second part of the attachment. This engagement between the mating surface and the seal can inhibit the leakage of air from between the first part and the second part of the attachment. This mating surface may be conveniently defined by an area of the external surface of the crevice nozzle which is located between the rails of the first guide mechanism and the channel of the second guide mechanism. The seal preferably comprises a first end which is retained by the neck, and a second end which is connected to a seal carriage which is moveable relative to the neck. As the second part is pushed over the first part, the ends of the rails preferably urge the carriage to move towards the first end of the seal, deforming the seal and urging it into contact with the mating surface of the crevice nozzle. The rails may engage the seal carriage directly, or via a moveable wedge member.

The attachment has been described in the form of a wand assembly in which the second part of the attachment comprises a wand. The wand extends between the neck and a lower end section which is connectable to a floor tool or other auxiliary suction tool. For example, the lower end section may be connected to a soft dusting brush to enable the appliance to be used to clean curtain rails or high shelves.

As an alternative, the wand may be replaced by an auxiliary suction tool, such as a stubborn dirt brush, a dusting brush, or an articulated cleaning brush, having a suction inlet for receiving an airflow. This can enable the attachment to take the alternative form of a two part tool for a vacuum cleaning appliance, in which a first part of the tool comprises a crevice nozzle and a brush section, and the second part of the tool comprises an auxiliary suction tool and is arranged to house the crevice nozzle and the brush section of the first part when the auxiliary suction tool is connected to the main body.

As mentioned above, the attachment is preferably in the form of a wand assembly. In a second aspect the present invention provides a wand assembly comprising:

- a first part comprising a crevice nozzle, a brush section which is moveable along the crevice nozzle between a retracted position and a deployed position, and a first connector for connecting the first part to a body of a vacuum cleaning appliance; and
- a second part comprising a wand and a second connector for connecting the second part to the first part, and wherein the second part is arranged to be push-fitted over the first part so that the crevice nozzle and the brush section are stored within the second part when the second part is connected to the first part.

As an alternative to connecting the second part directly to the first part, the second connector may connect the second part directly to the body of the appliance when it is pushed over the first part. In a third aspect, the present invention provides a vacuum cleaning appliance comprising:

- a body comprising a suction source; and
- an attachment releasably connected to the body, the attachment comprising:
  - a first part comprising a crevice nozzle, a brush section which is moveable relative to the crevice nozzle between a retracted position and a deployed position, and a first connector for releasably connecting the first part to a body of the appliance; and
  - a second part comprising a suction inlet and a second connector for releasably connecting the second part to the body of the appliance, and wherein the second part is arranged to be push-fitted over the first part so that the crevice nozzle and the brush section are stored within the second part when the second part is connected to the body of the appliance.

In a fourth aspect, the present invention provides an attachment for a vacuum cleaning appliance, the attachment comprising:

- a first part comprising a brush section comprising a plurality of bristles and a bristle sleeve extending about the bristles and arranged such that at least the tips of the bristles protrude forwardly from the sleeve, and a first connector for connecting the first part to a body of the appliance; and
- a second part comprising a suction inlet and a second connector for connecting the second part to the body of the appliance, and wherein the second part is arranged to be push-fitted over the first part so that the brush section is stored within the second part when the second part is connected to the body of the appliance.

Features described above in connection to the first aspect of the invention are equally applicable to each of the second to fourth aspects of the invention, and vice versa.

BRIEF DESCRIPTION OF THE DRAWINGS

Preferred features of the invention will now be described, by way of example only, with reference to the accompanying drawings, in which:

FIG. 3(*c*) is a sectional view taken along line E-E in FIG. 2(*b*);

DETAILED DESCRIPTION OF THE INVENTION

Figure 1:
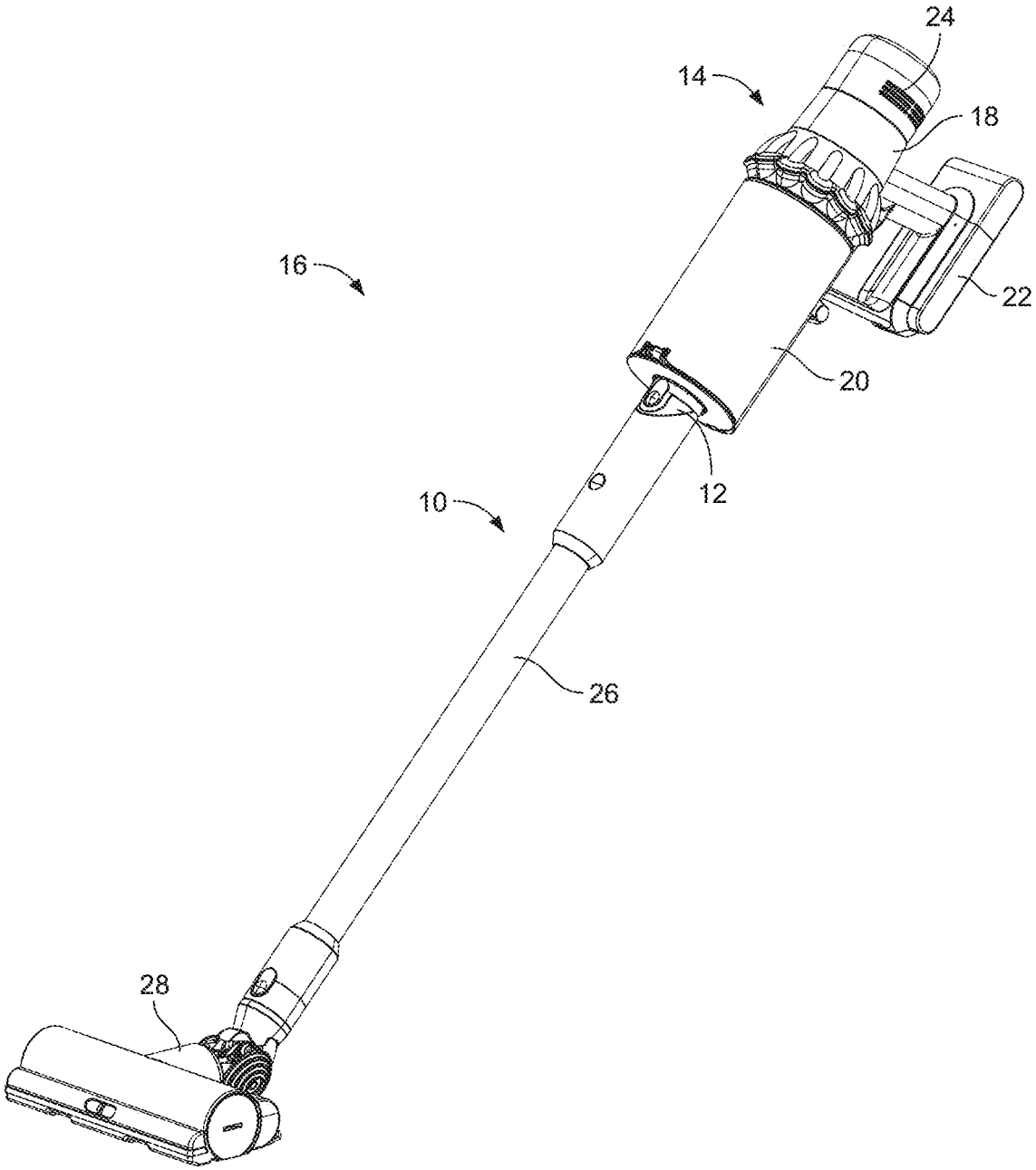
FIG. 1 is a perspective view of a vacuum cleaning appliance.

An embodiment of an attachment for a vacuum cleaning appliance will be described with reference to FIGS. 1 to 20(*b*). In this embodiment, the attachment is in the form of a two-part wand assembly 10. With reference first to FIG. 1, the wand assembly 10 comprises a first part 12 which attaches the wand assembly 10 to a main body 14 of the vacuum cleaning appliance 16. As is well known, the main body 14 comprises a suction source 18 for generating an airflow through the appliance 16, a separation system 20 for separating dirt and other debris from the airflow, a power source 22 for driving various components of the appliance 16, including the suction source 18, and an air outlet 24.

The wand assembly 10 further comprises a second part 26 connected to the first part 12. A floor tool 28 is connected to a lower end section of the second part 26. A dirt-bearing airflow is drawn into the appliance 16 through the floor tool 28. As illustrated in FIG. 1, the appliance 16 may be a handheld vacuum cleaning appliance, in which case the wand assembly 10 is connected directly to the main body 14. Alternatively, the appliance may be a cylinder vacuum cleaning appliance, in which case the wand assembly 10 is disposed between the floor tool 28 and a hose for conveying the dirt-bearing airflow from the wand assembly 10 to the main body 14.

Figure 2A:
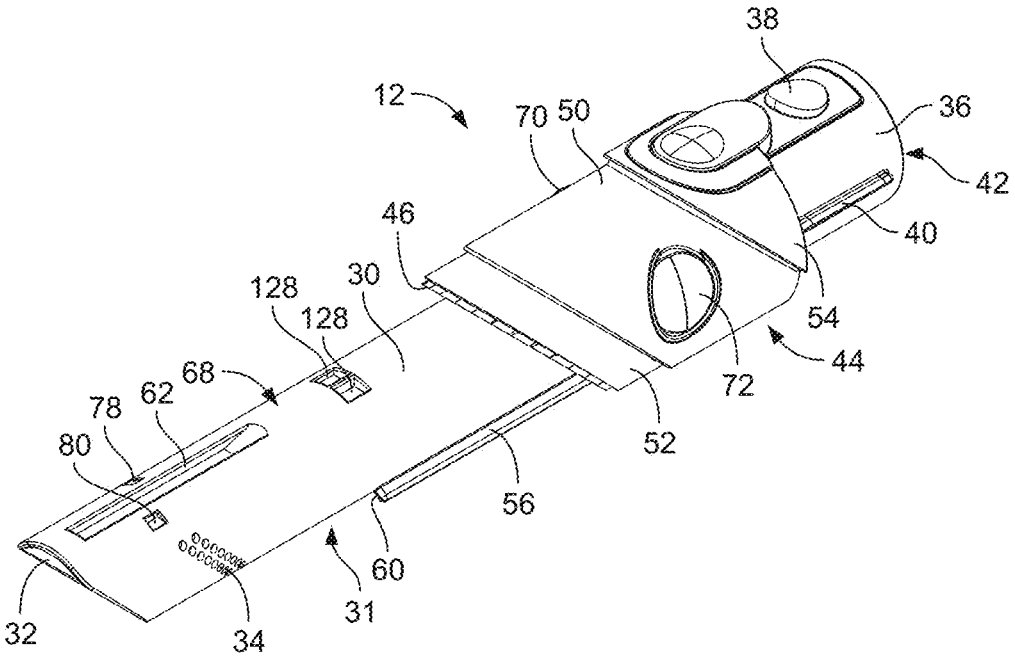
FIG. 2(*a*) is a perspective view of a first part of a wand assembly of the appliance, with a brush section in a retracted position, and FIG. 2(*b*) is a rear view of the first part as illustrated in FIG. 2(*a*)
Figure 2B:
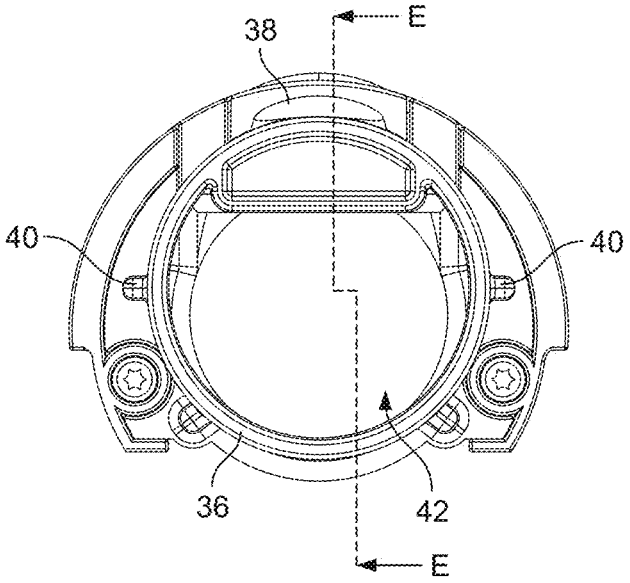
Figure 3A:
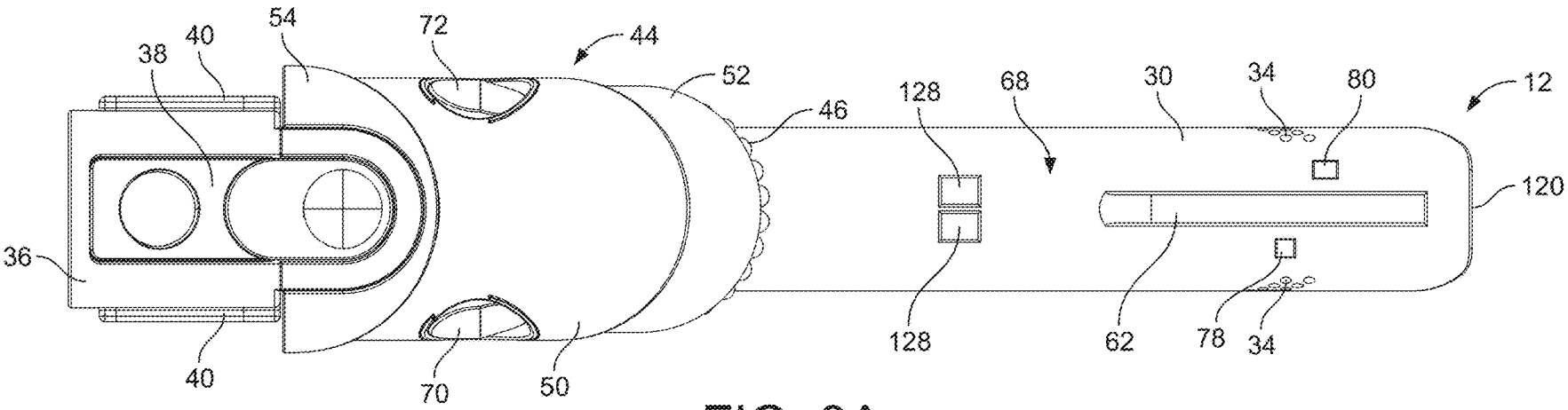
FIG. 3(*a*) is a top view of the first part as illustrated in FIG. 2(*a*), FIG. 3(*b*) is a side view of the first part as illustrated in FIG. 2(*a*)
Figure 3B:
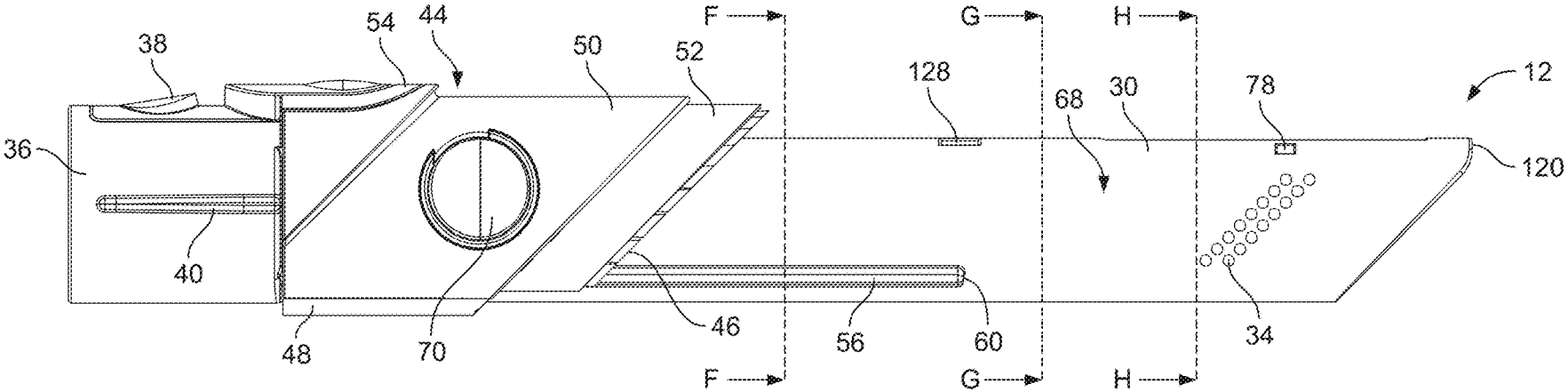
Figure 3C:
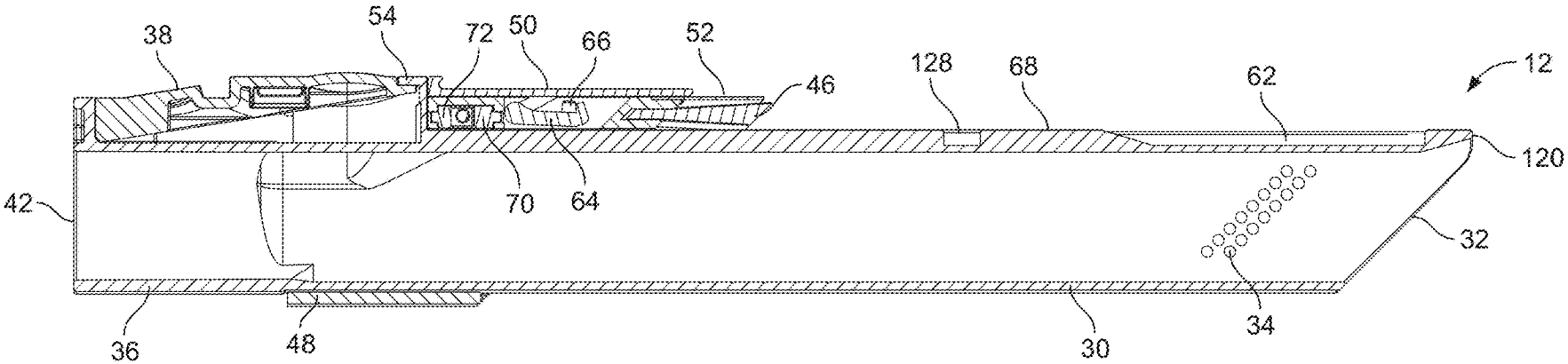

The first part 12 of the wand assembly 10 is illustrated in more detail in FIGS. 2(*a*) to 8(*d*). The first part 12 of the wand assembly 10 comprises a crevice tool, having a main body defining a crevice nozzle 30 having a front section 31, an air inlet 32 located at a front end of the front section 31, and air bleeds 34 located on a side surface of the front section 31. The main body includes a tubular rear section 36 which is inserted into the main body 14 of the appliance 16. The rear section 36 includes a manual release catch 38 for releasably connecting the first part 12 to the main body 14 of the appliance 16 as the rear section 36 is inserted into the main body 14, a pair of guide rails 40 for aligning the first part 12 with the main body 14 as the rear section 36 is inserted into the main body 14, and an air outlet 42 from which air enters the main body 14 from the wand assembly 10. The connector 38 is depressed by a user to release the first part 12 from the main body 14, and is biased by a spring (not shown) towards the raised position illustrated in the figures for retaining the first part 12 within the main body 14.

Figure 5A:
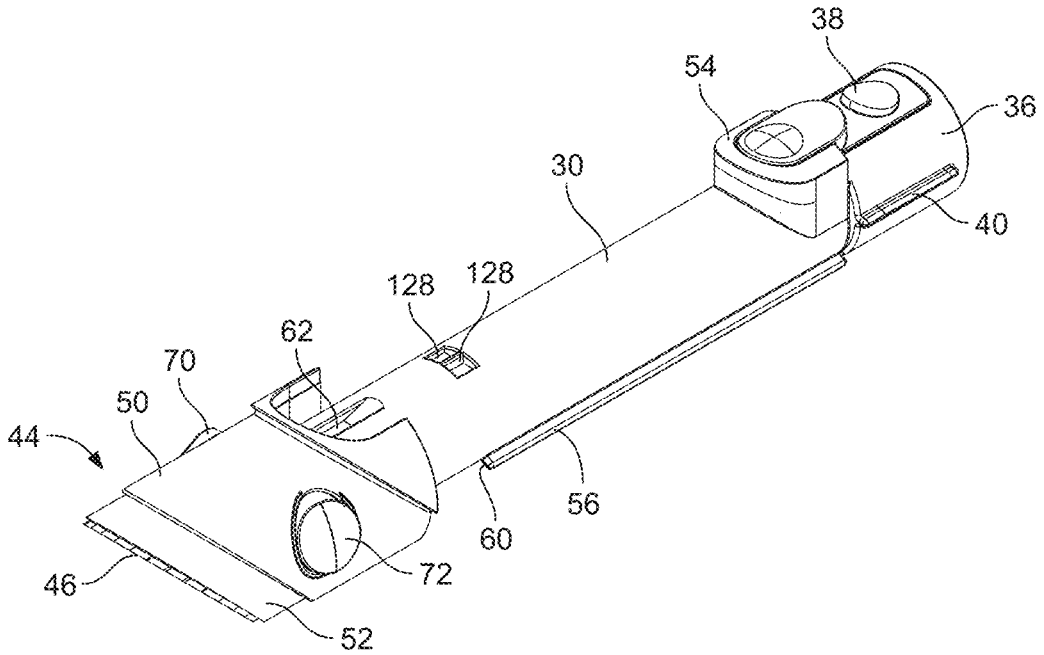
FIG. 5(*a*) is a perspective view of the first part of the wand assembly, with the brush section in a deployed position, and FIG. 5(*b*) is a rear view of the first part as illustrated in FIG. 5(*a*)
Figure 5B:
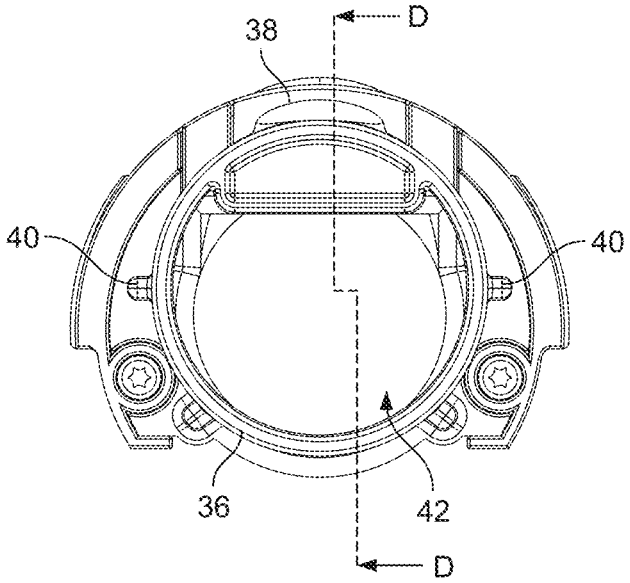
Figure 6A:
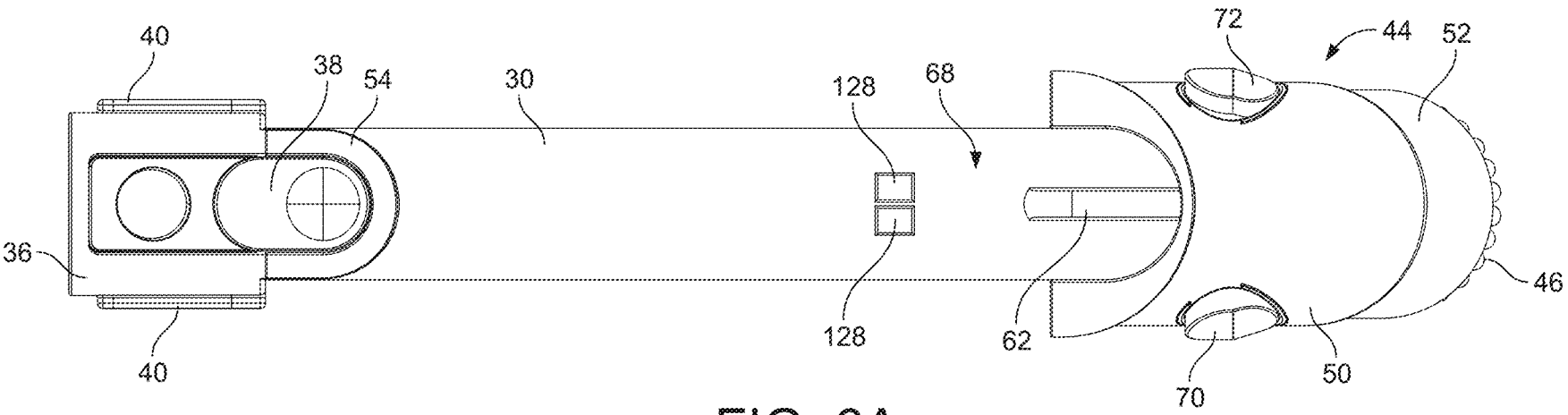
FIG. 6(*a*) is a top view of the first part as illustrated in FIG. 5(*a*), and FIG. 6(*b*) is a sectional view taken along line D-D in FIG. 5(*b*)
Figure 6B:
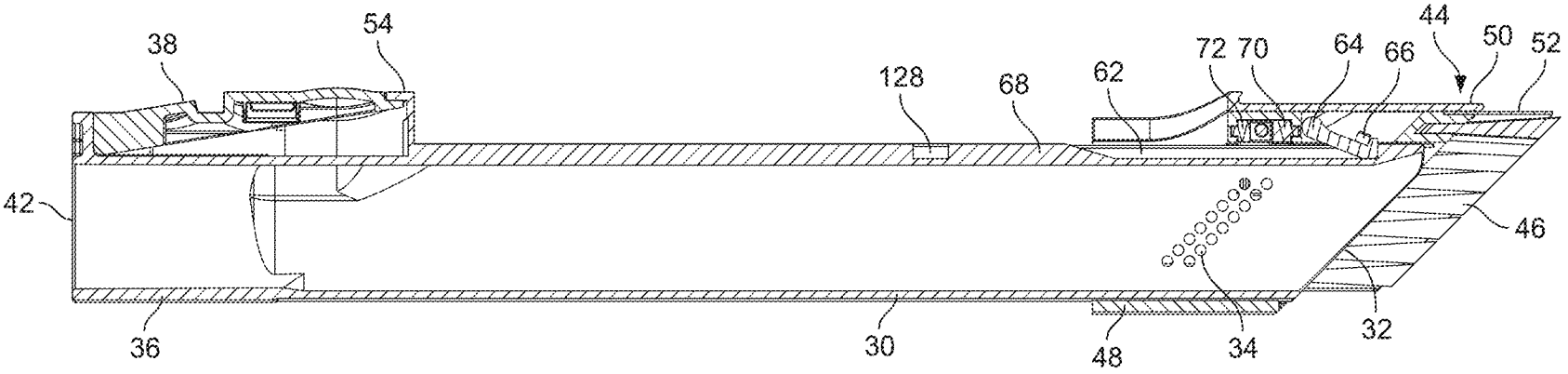
Figure 7:
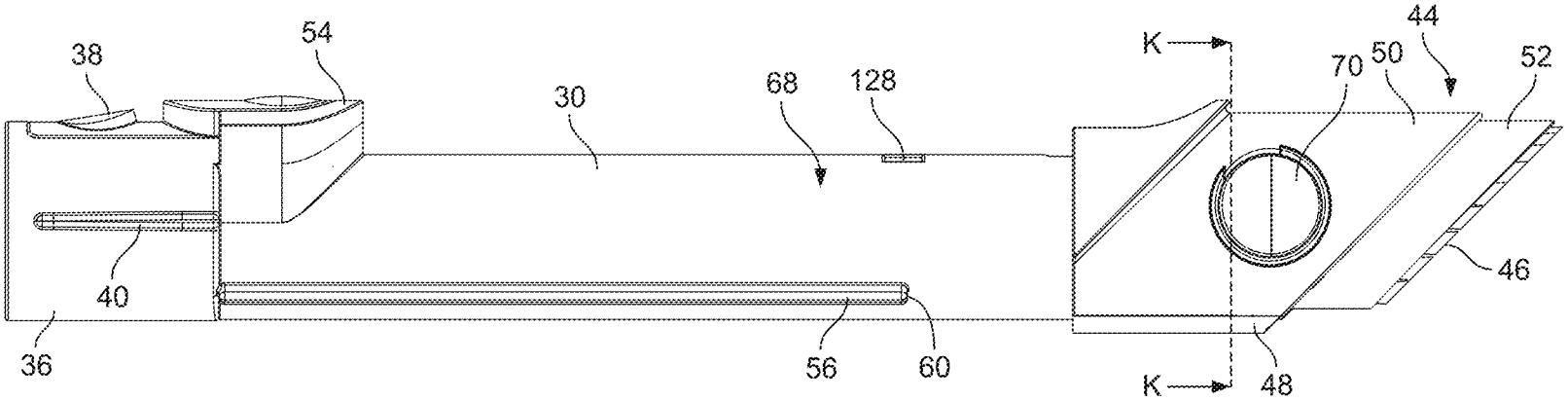
FIG. 7 is a side view of the first part as illustrated in FIG. 5(*a*)
Figure 8C:
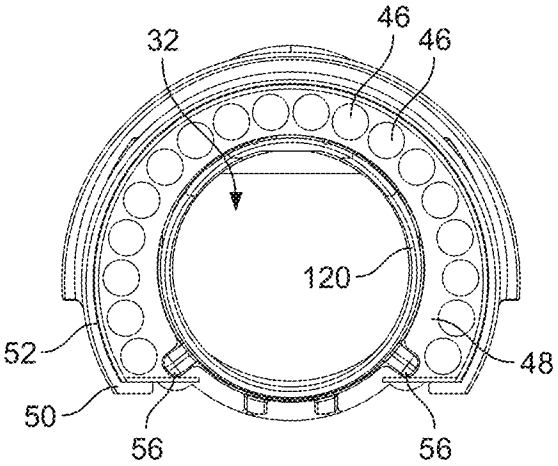
FIG. 8(*a*) is a front view of the first part as illustrated in FIG. 5(*a*), FIG. 8(*b*) is a sectional view taken along line K-K in FIG. 7, FIG. 8(*c*) is a similar view to FIG. 8(*a*) but with actuators depressed to release the brush part from its deployed position, and FIG. 8(*d*) is a similar view to FIG. 8(*b*) but with the actuators depressed.
Figure 8D:
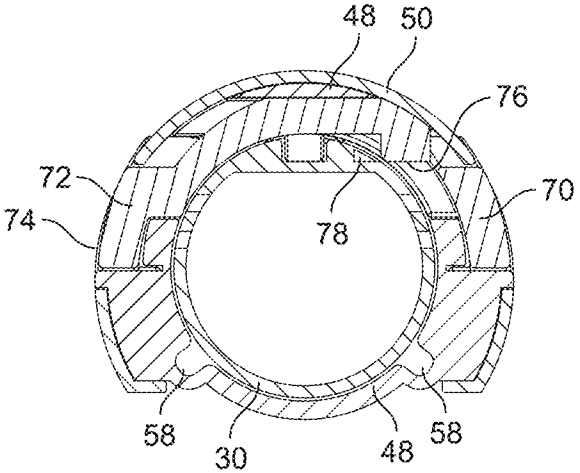
Figure 8A:
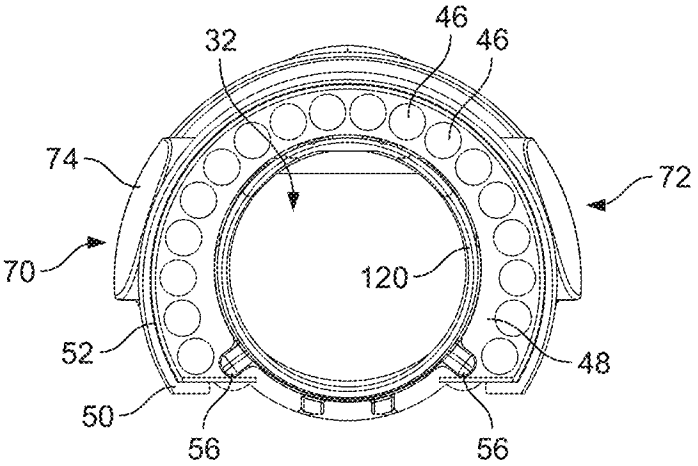
Figure 8B:
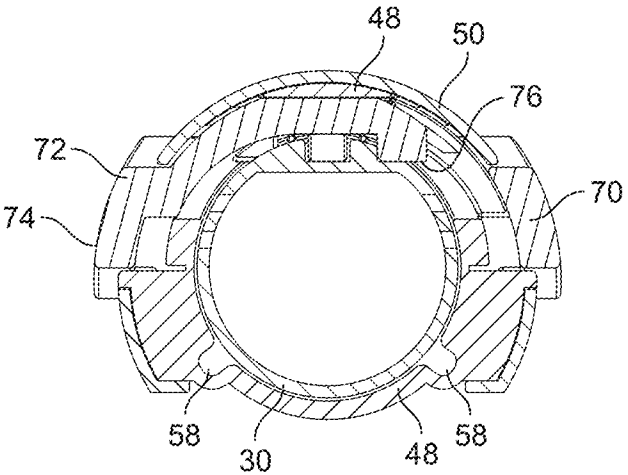

The first part 12 of the wand assembly 10 also includes a brush section 44. As described in more detail below, the brush section 44 is moveable relative to the crevice nozzle 30 between a retracted position, as illustrated in FIGS. 2(*a*) to 3(*c*), and a deployed position, as illustrated in FIGS. 5(*a*) to 8(*d*). The brush section 44 comprises a set of bristles 46 mounted on a brush collar 48. The bristles 46 are arranged such that they are substantially parallel, and such that the bristles 46 extend in a direction which is substantially parallel to the longitudinal axis of the crevice nozzle 30. With reference also to FIG. 8(*a*), the brush collar 48 extends at least partially about the crevice nozzle 30. In this embodiment the brush collar 48 surrounds the crevice nozzle 30. The bristles 46 are arranged in an array which extends partially about the crevice nozzle 30, preferably by an angle which is between 180 and 360°, and which is preferably less than 270°. In this embodiment, the array of bristles 46 extends about the crevice nozzle 30 by an angle of approximately 250°.

By way of example, the bristles 46 may be formed from nylon or carbon fibre, and the brush collar 48 may be formed from plastics material. The bristles 46 may be attached to the brush collar 48 using an over-moulding technique. In this embodiment, the bristles 46 are arranged in a plurality of bristle tufts spaced about the brush collar 48.

The brush section 44 also includes a brush cover 50 which extends partially about the brush collar 48, and a bristle sleeve 52 which extends about the array of bristles 46. The bristle sleeve 52 has one end sandwiched between the brush collar 48 and the brush cover 50, and a free end located adjacent to the free ends of the bristles 46.

The bristle sleeve 52 is provided to minimise outward bending, or splaying, of the bristles 46 both during use of the brush section 44 by a user, or, as described in more detail below, as the second part 26 of the wand assembly 10 is pushed over the first part 12 during assembly. The bristle sleeve 52 is arranged such that the free ends of the bristles 46 protrude outwardly beyond the free end of the bristle sleeve 52. Preferably, no more than 20% of the length of the bristles 46, more preferably no more than 10% of the length of the bristles 46, protrudes beyond the free end of the bristle sleeve 52. The bristle sleeve 52 is positioned in close proximity to the external side surfaces of the bristles 46, preferably within 5 mm of the external side surfaces of the bristles 46. The bristle sleeve 52 is preferably formed from a flexible material, and in this embodiment is formed from a polyurethane plastics material, such as thermoplastic polyurethane (TPU).

FIGS. 2(*a*) to 3(*c*) illustrate the brush section 44 in a retracted position relative to the crevice nozzle 30. In its retracted position, the brush section 44 is located adjacent the rear section 36 of the crevice nozzle 30, with the brush cover 50 abutting a housing 54 for the catch 38 for connecting the first part 12 to the main body 14 of the appliance 16. This enables the first part 12 of the wand assembly 10 to be used in a "crevice mode", in which the crevice nozzle 30 is inserted between gaps in furniture and the like during cleaning. To move the brush section 44 towards its deployed position, as illustrated in FIGS. 5(*a*) to 8(*d*), the user grips the brush cover 50 and pulls the brush section 44 along the crevice nozzle 30 towards its deployed position.

Figure 4C:
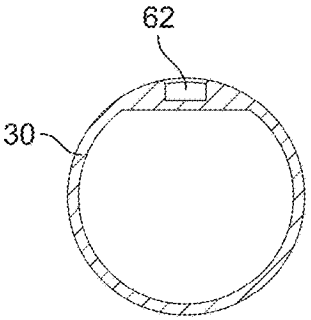
FIG. 4(*a*) is a sectional view taken along line F-F in FIG. 3(*b*), FIG. 4(*b*) is a sectional view taken along line G-G in FIG. 3(*b*), and FIG. 4(*c*) is a sectional view taken along line H-H in FIG. 3(*b*)
Figure 4B:
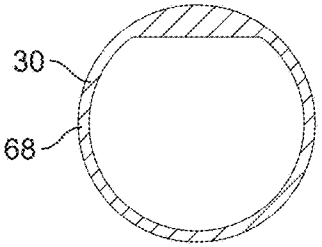
Figure 4A:
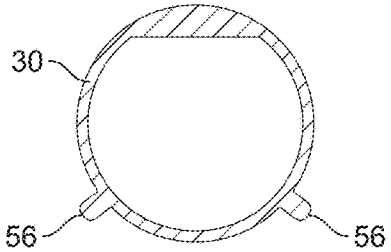

The first part 12 includes guide mechanisms for guiding the movement of the brush section 44 relative to the crevice nozzle 30. These mechanisms ensure that the brush section 44 moves linearly along the crevice nozzle 30 as it moves between its retracted position and its deployed position. As described in more detail below, the first part 12 includes two guide mechanisms for guiding the movement of the brush section 44 relative to the crevice nozzle 30. With reference also to FIGS. 4(*a*) and 8(*b*), a first guide mechanism comprises a pair of parallel rails 56 located on opposite sides of the crevice nozzle 30 and extending parallel to the longitudinal axis of the first part 12, and a pair of parallel channels 58 formed on the brush collar 48 for receiving the rails 56. The rails 56 extend from the rear section 36 of the crevice nozzle 30, and terminate at free ends 60 located partway along the crevice nozzle 30. With reference to FIGS. 2(*a*) to 3(*c*) and 4(*c*), the second guide mechanism comprises a channel 62 extending linearly along the upper surface of the crevice nozzle 30, parallel to the longitudinal axis of the first part. The channel 62 begins at a position which is both axially and angularly spaced from the free ends of the rails 56, and terminates adjacent to the air inlet 32. The second guide mechanism further comprises a pawl 64 connected to the brush cover 50 for pivoting movement relative thereto, and which is biased by a spring 66 against the upper surface of the crevice nozzle 30. The pawl 64 is positioned so that it enters the channel 62 as the brush section 44 moves towards its deployed position, and preferably before the channels 58 of the brush collar 48 become fully disengaged from the rails 56 of the crevice nozzle 30.

With reference also to FIG. 4(*b*), the axial spacing of the channel 62 from the rails 56 defines a tubular section 68 of the crevice nozzle 30 which is located between the rails 56 and the channel 62. The tubular section 68 has a substantially circular outer profile. As discussed in more detail below, the external surface of the tubular section 68 of the crevice nozzle 30 provides an annular mating surface for engaging a seal of the second part 26 of the wand assembly 10 to inhibit the leakage of air from between the first part 12 and the second part 26 of the assembled wand assembly 10.

Returning to FIGS. 5(*a*) to 8(*d*), in the deployed position of the brush section 44 the pawl 64 is located at the end of the channel 62 located adjacent to the air inlet 32, and the bristles 46 are located beyond the air inlet 32 of the crevice nozzle 30. This enables the first part 12 of the wand assembly 10 to be used in a "brush mode" in which the bristles 46 can agitate dust and debris from exposed surfaces of furniture and household items, for example, during cleaning to become entrained in the airflow entering the crevice nozzle 30 through the air inlet 32.

The brush section 44 includes a mechanism for retaining the brush section 44 in its deployed position. This prevents the brush section 44 from moving relative to the crevice nozzle 30 during use of the first part 12 in its brush mode. The retaining mechanism comprises a pair of retention catches in the form of fingers 70, 72 which are carried by the brush section 44. With reference to FIG. 8(*b*), each finger has a base 74 and a tip 76. Each finger 70, 72 is biased by a respective spring (not shown) for movement relative to the crevice nozzle 30 in such a direction that urges its tip 76 against the external surface of the crevice nozzle 30. At the deployed position of the brush section 44, under the action of the biasing springs the tip 76 of each finger 70, 72 enters a respective recess 78, 80 located on the external surface of the crevice nozzle 30. The engagement between the fingers 70, 72 and the recesses 78, 80 serves to retain the brush section 44 in its deployed position.

As the fingers 70, 72 move relative to the crevice nozzle 30 to retain the brush section 44 in its deployed position, the bases 74 of the fingers 70, 72 protrude outwardly from respective apertures formed in the brush cover 50, as illustrated in FIGS. 5(*a*) to 8(*b*). With reference to FIGS. 8(*c*) and 8(*d*), to release the brush section 44 from its deployed position, a user manually squeezes the bases 74 of the fingers 70, 72 to urge the tips 76 of the fingers 70, 72 out from the recesses 78, 80. The user may then simultaneously move the brush section 44 towards its retracted position. As illustrated in FIGS. 2(*a*) to 3(*c*), when the brush section 44 is positioned remote from the deployed position, the bases 74 of the fingers 70, 72 are retracted so as to not protrude from the apertures formed in the brush cover 50.

Figure 9A:
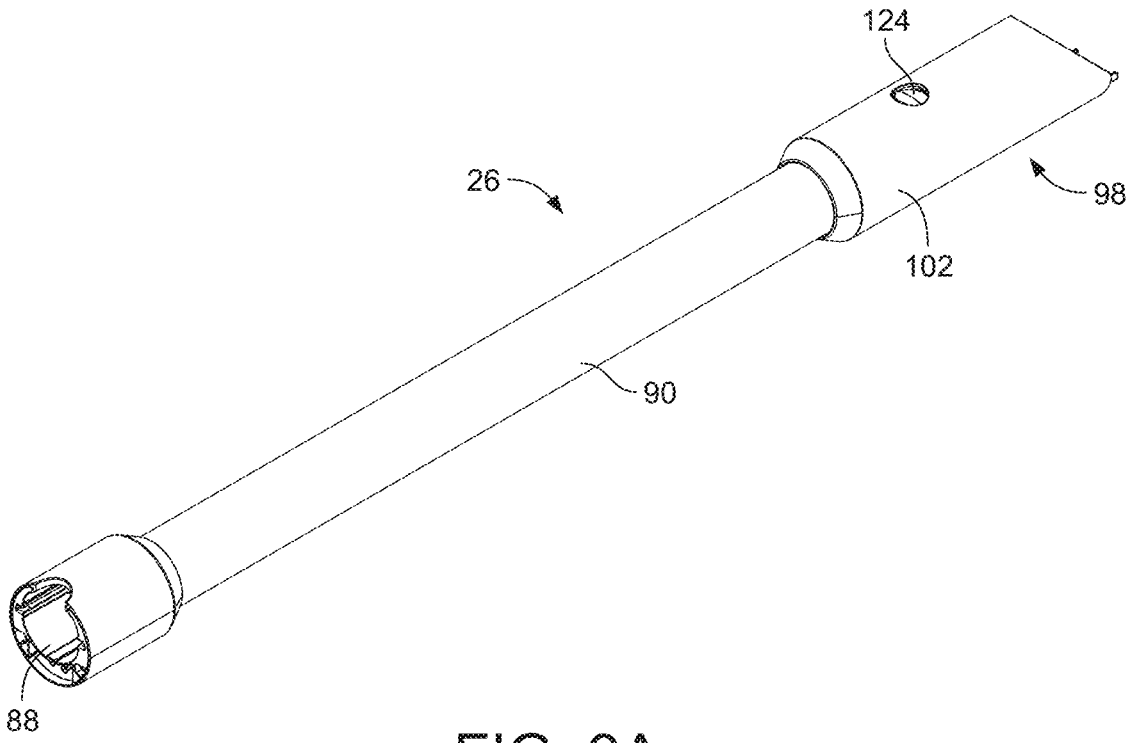
FIG. 9(*a*) is a perspective view of a second part of the wand assembly, and FIG. 9(*b*) is a rear view of the second part.
Figure 9B:
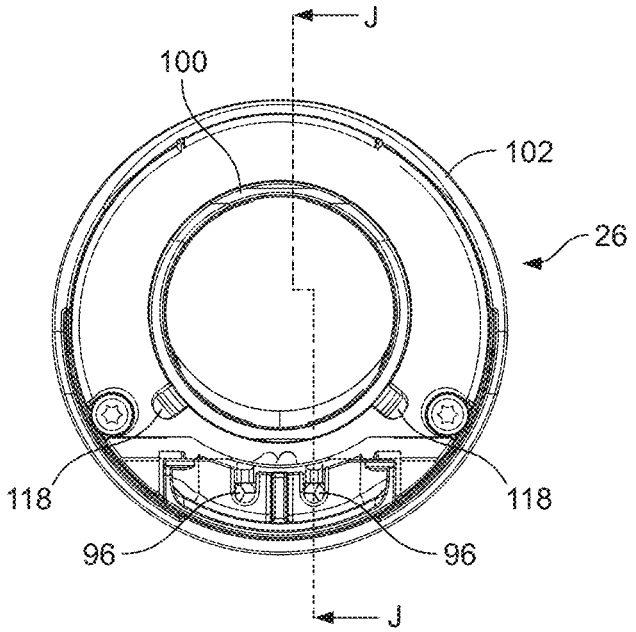
Figure 10A:
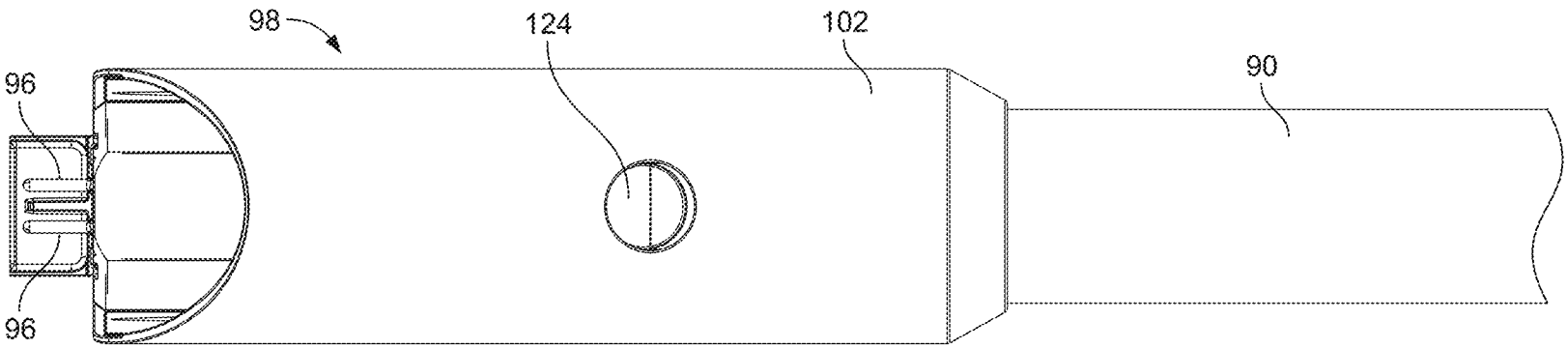
FIG. 10(*a*) is a top view of a portion of the second part of the wand assembly, FIG. 10(*b*) is a side view of that portion of the second part of the wand assembly, and FIG. 10(*c*) is a sectional view of that portion of the second part, taken along line J-J in FIG. 9(*b*)
Figure 10B:
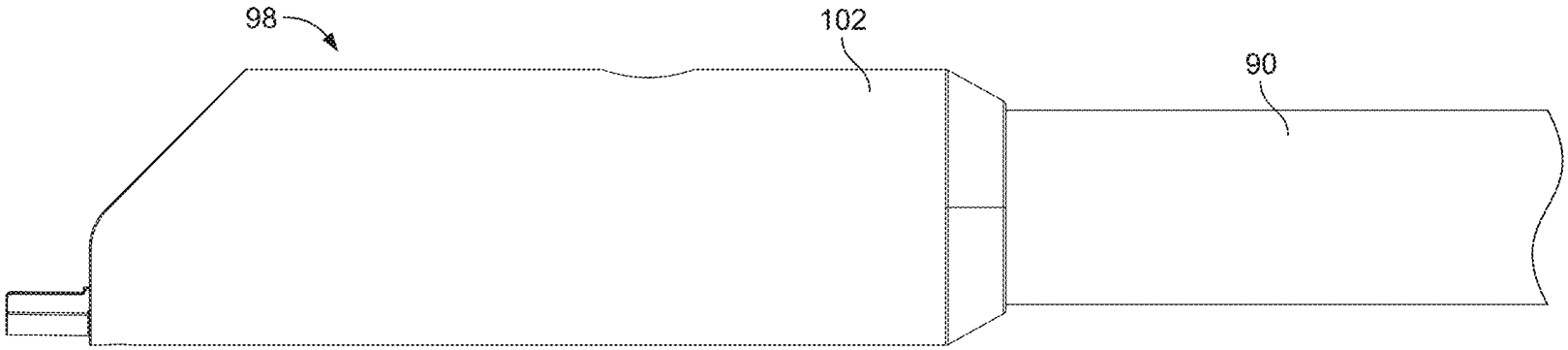
Figure 10C:
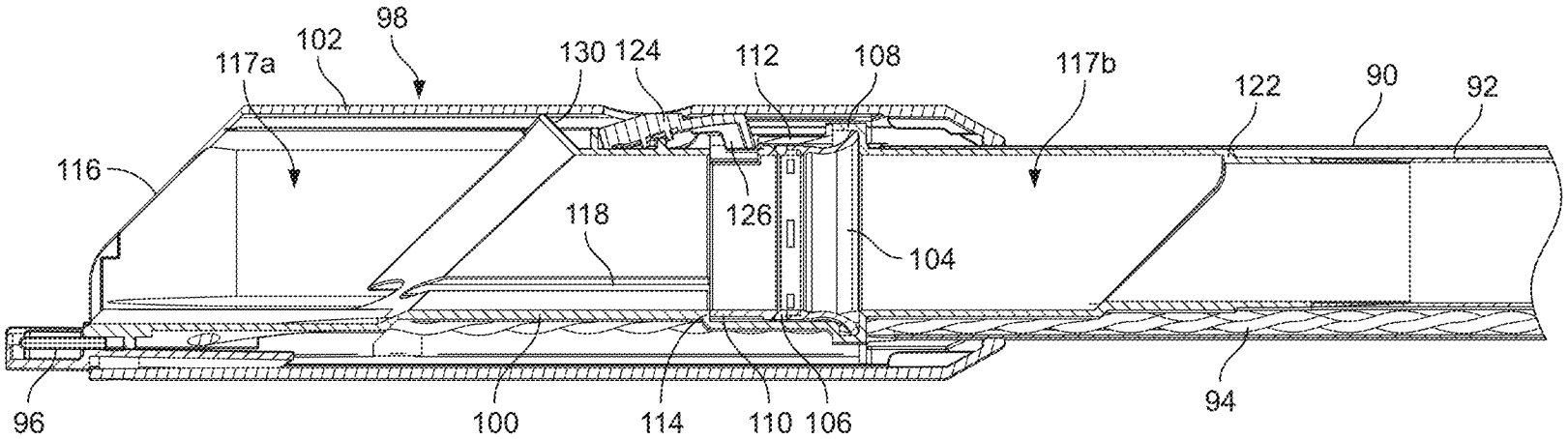

The second part 26 of the wand assembly 10 will now be described with reference to FIGS. 9(*a*) to 10(*c*). The second part 26 comprises a suction inlet 88 located at the lower end section of a wand. The wand comprises an outer tube 90 extending about an inner tube 92 which conveys the airflow from the floor tool 28 towards the main body 14 of the appliance 16. Wires 94 for supplying power to the floor tool 28 are housed between the outer tube 90 and the inner tube 92, and terminate at connector pins 96 located at the upper end of the second part 26.

An upper section of second part 26 includes a neck 98 for receiving the first part 12 of the wand assembly 10. The neck 98 comprises a neck body 100 which is connected to the inner tube 92, and a neck cover 102 which extends about the neck body 100 and is connected to the outer tube 90. As described in more detail below, the neck body 100 and neck cover 102 are shaped to house the first part 12 of the wand assembly 10 when the first part 12 and the second part 26 are connected together. At least part of the neck cover 102 may be formed from transparent material to enable the first part 12 to be visible to a user when the first part 12 and the second part 26 are connected together. This can provide a visual reminder to the user of the presence of the crevice tool stored within the neck 98.

The second part 26 of the wand assembly 10 includes a sealing mechanism for engaging the annular mating surface of the tubular section 68 of the crevice nozzle 30. The sealing mechanism comprises a seal 104 which is in the form of a flexible tube preferably formed from rubber or other elastomeric material. The one end of the seal 104 is connected to a first end of an annular seal carriage 106, preferably using an over-moulding process, whereas the free end of the seal 104 is retained within an annular housing 108 defined by the neck body 100. The second end of the seal carriage 106 is engaged by a first end of an annular wedge 110 which is moveable axially within and relative to the neck body 100. The wedge 110 is retained within the neck body 100 by wedge holder 112 which partially extends about the wedge 110. Wall 114 of the neck body 100 provides an end stop for restricting the movement of the wedge 110 towards the upper open end 116 of the second part 26 due to relaxation of the seal 104.

The connection of the first part 12 to the second part 26 of the wand assembly 10 will be described with reference to FIGS. 11(*a*) to 12(*d*). With the brush section 44 of the first part 12 in its retracted position, the crevice nozzle 30 is inserted through the upper open end 116 of the second part 26. Returning to FIG. 10(*c*), the neck 98 comprises a relatively wide internal section 117*a* for housing the rear section 36 and the brush section 44 of the first part 12, and a relatively narrow internal section 117*b* for receiving the front section 31 of the first part 12. The inner surface of the neck body 100 includes a pair of grooves 118 for receiving the rails 56 located on the external surface of the crevice nozzle 30. This ensures that the second part 26 is accurately angularly aligned with the first part 12 as it is pushed over the first part 12.

The second part 26 is pushed over the first part 12 until the end 120 of the crevice nozzle 30 engages an end stop 122 defined by the relatively narrow internal section 117*b* of the neck body 100. To connect the first part 12 to the second part 26, the second part 26 comprises a catch 124 which is biased by a spring (not shown) to engage the upper surface of the crevice nozzle 30 as it is inserted into the second part 26. As illustrated in FIGS. 12(*c*) and 12(*d*), when the first part 12 has been fully inserted into the second part 26 end portions 126 of the catch 124 enter a pair of recesses 128 located on the upper surface of the crevice nozzle 30. This prevents the first part 12 and the second part 26 from being accidentally pulled apart during use of the wand assembly 10.

As the first part 12 becomes fully inserted into the second part 26, the ends 60 of the rails 56 engage the wedge 110 and push the wedge 110 against the seal carriage 106. This causes the seal carriage 106 to move towards the housing 108, which in turn causes the seal 104 to deform and engage the annular mating surface defined by the tubular section 68 of the crevice nozzle 30. This causes an air tight seal to be formed between the crevice nozzle 30 and the neck body 100, and thus between the first part 12 and the second part 26 of the wand assembly 10.

Figure 11A:
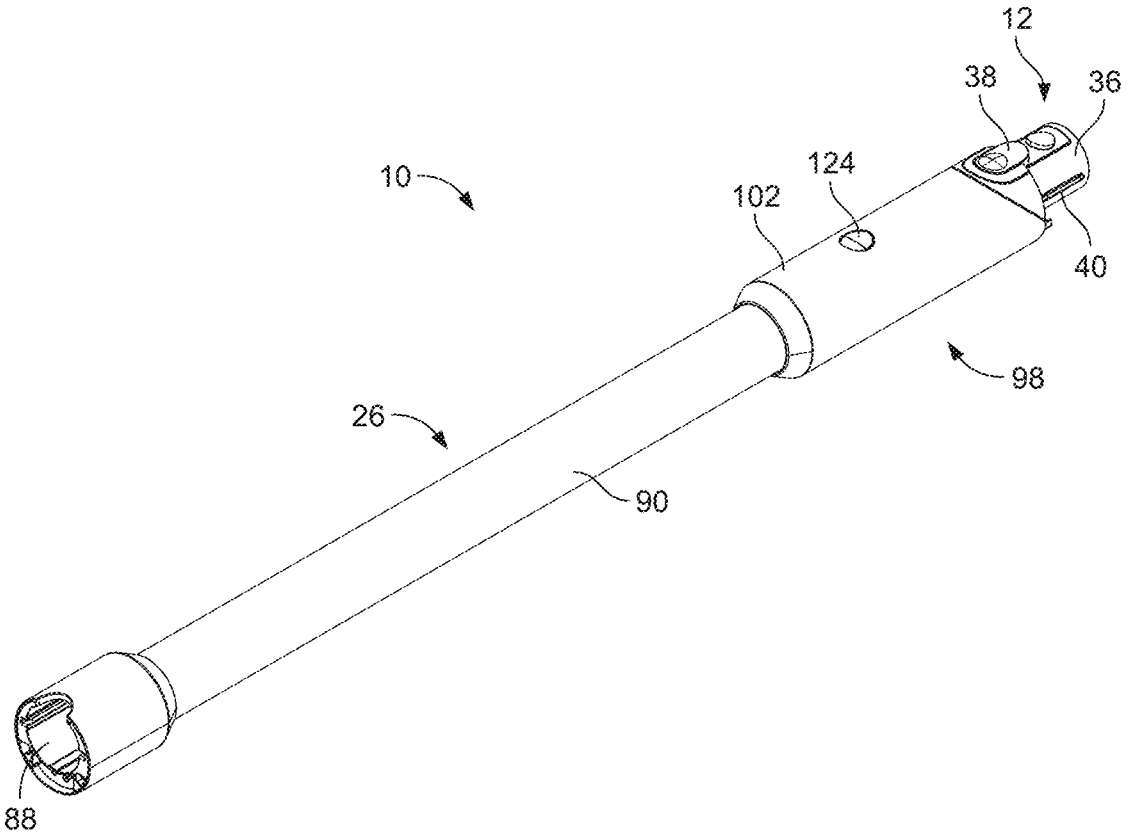
FIG. 11(*a*) is a perspective view of the wand assembly, in which the two parts of the wand assembly are connected to one another, and FIG. 11(*b*) is a rear view of the assembly as illustrated in FIG. 11(*a*)
Figure 11B:
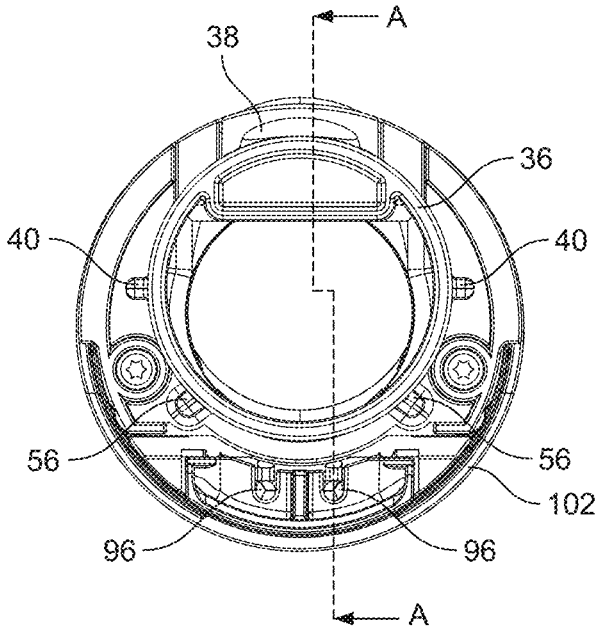
Figure 12A:
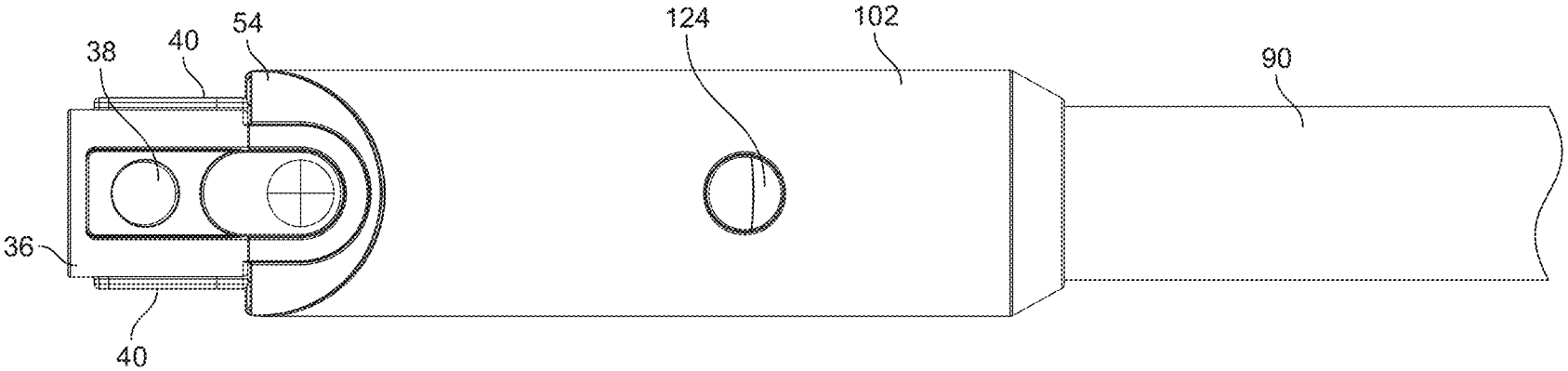
FIG. 12(*a*) is a top view of a portion of the wand assembly as illustrated in FIG. 11(*a*), FIG. 12(*b*) is a side view of the portion of the wand assembly illustrated in FIG. 12(*a*), FIG. 12(*c*) is a sectional view of that portion of the wand assembly, taken along line A-A in FIG. 11(*b*), and FIG. 12(*d*) is a close up of part of FIG. 12(*c*)
Figure 12B:
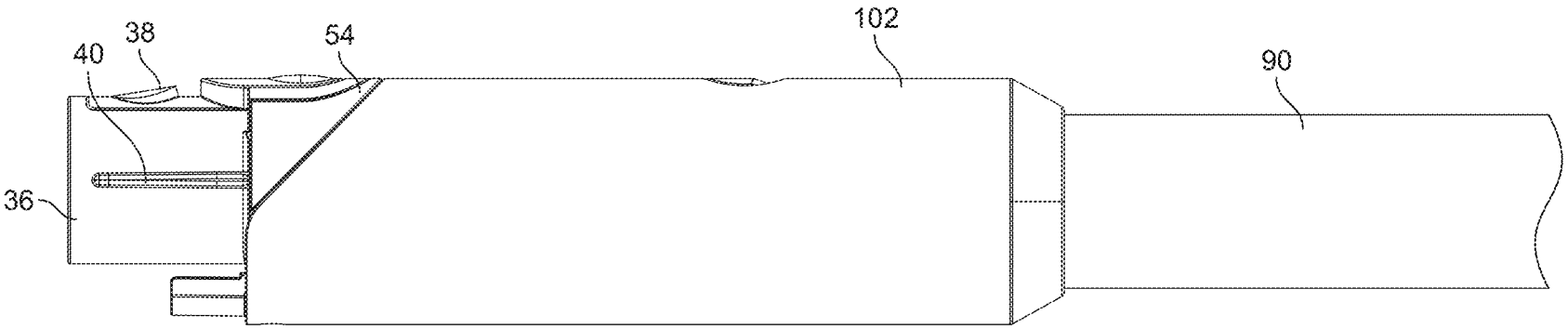
Figure 12C:
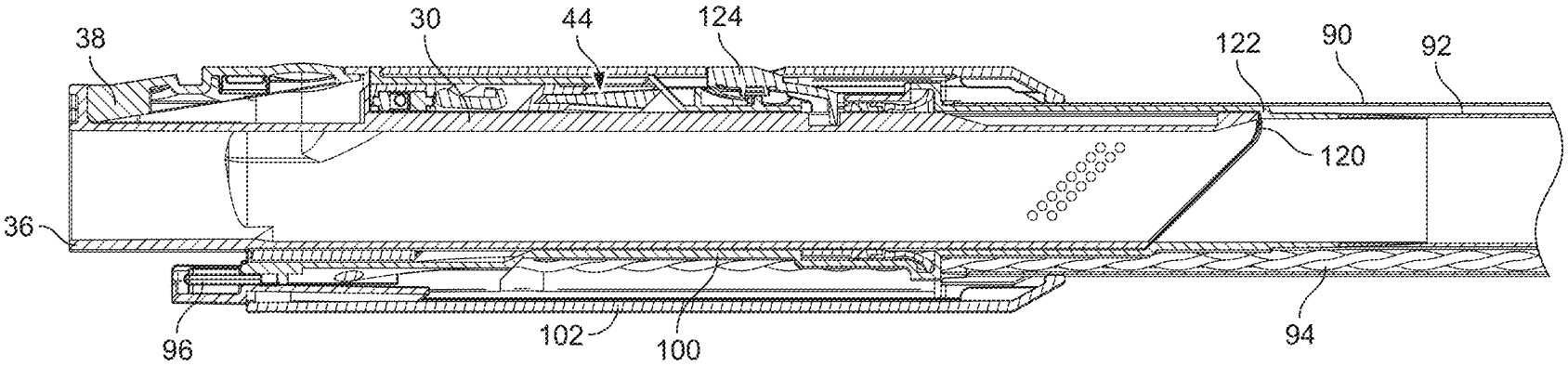
Figure 12D:
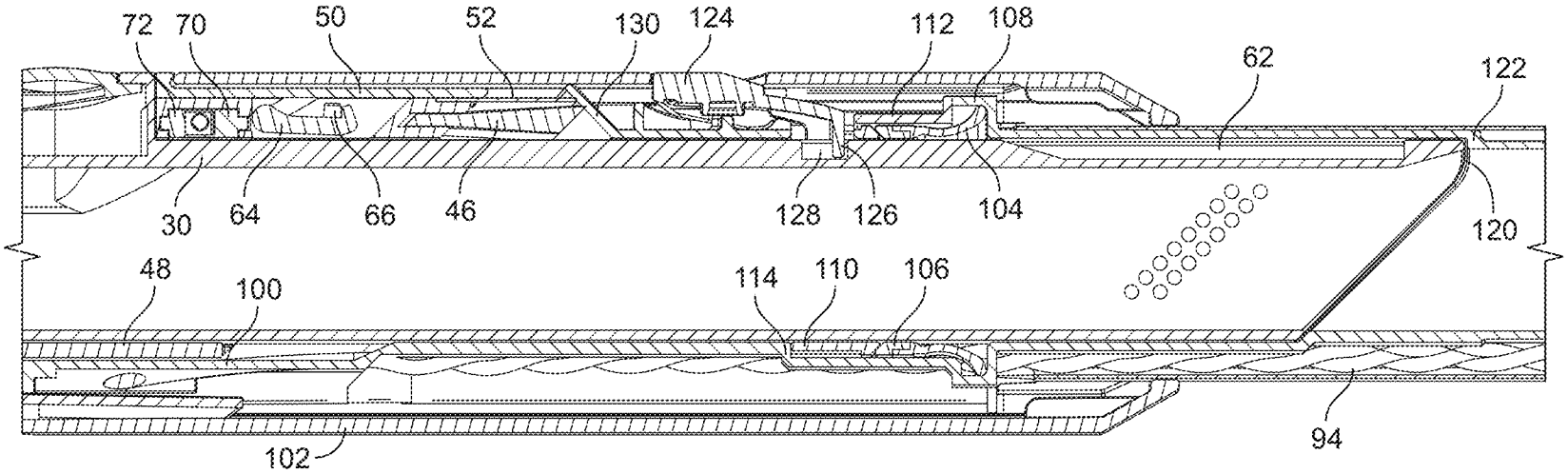

As illustrated in FIGS. 11(*a*) to 12(*d*), when the first part 12 is connected to the second part 26 of the wand assembly 10, both the crevice nozzle 30 and the brush section 44 of the first part 12 are housed within the second part 26. This inhibits damage to the brush section 44 during use of the wand assembly 10 to clean a floor surface, for example, as illustrated in FIG. 1.

Figure 13A:
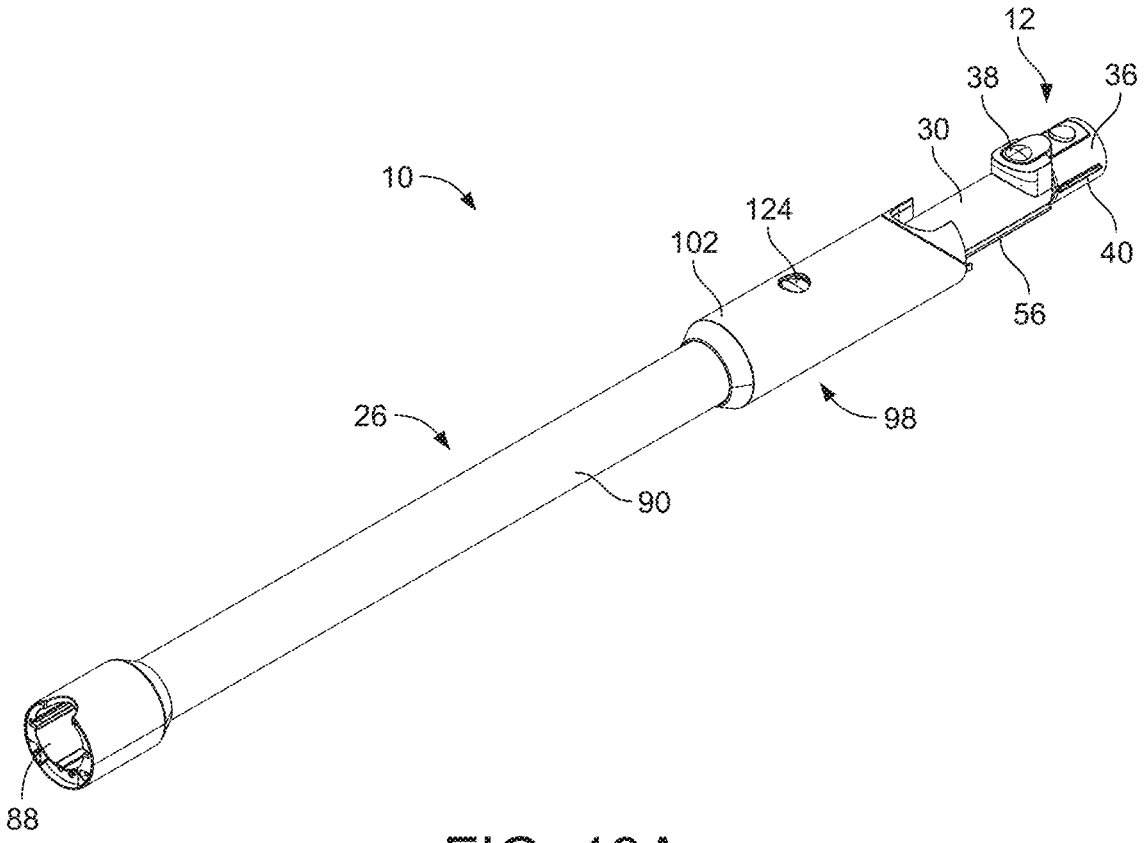
FIG. 13(*a*) is a perspective view of the wand assembly in which a first part of the wand assembly is partially withdrawn from a second part of the wand assembly, and FIG. 13(*b*) is a rear view of the assembly as illustrated in FIG. 13(*a*)
Figure 13B:
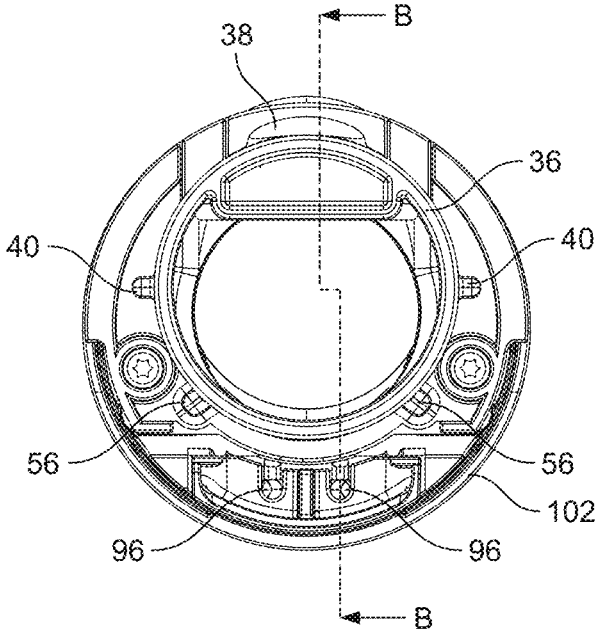
Figure 14A:
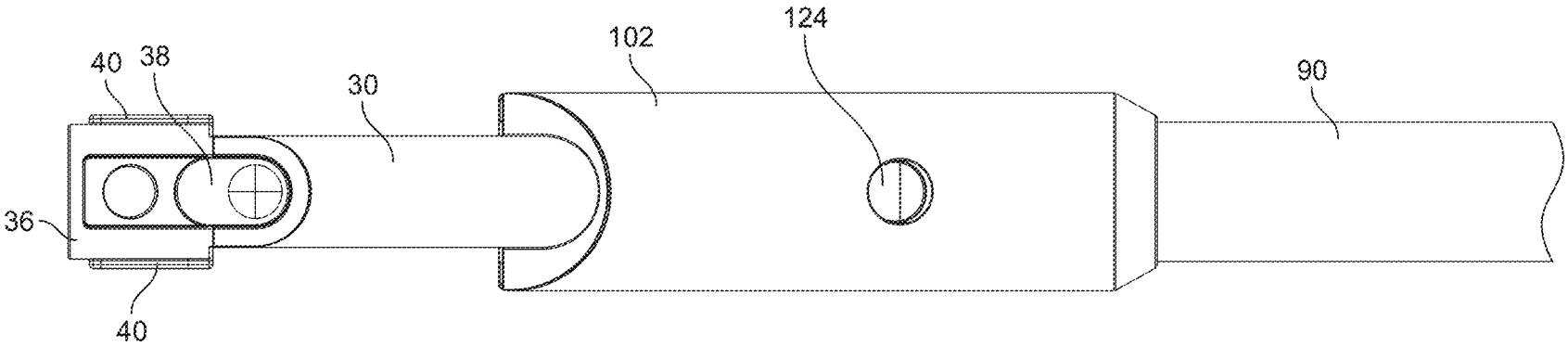
FIG. 14(*a*) is a top view of a portion of the wand assembly as illustrated in FIG. 13(*a*), FIG. 14(*b*) is a side view of that portion of the wand assembly illustrated in FIG. 13(*a*), FIG. 14(*c*) is a sectional view taken along line B-B in FIG. 13(*b*), and FIG. 14(*d*) is a close up of part of FIG. 14(*c*)
Figure 14B:
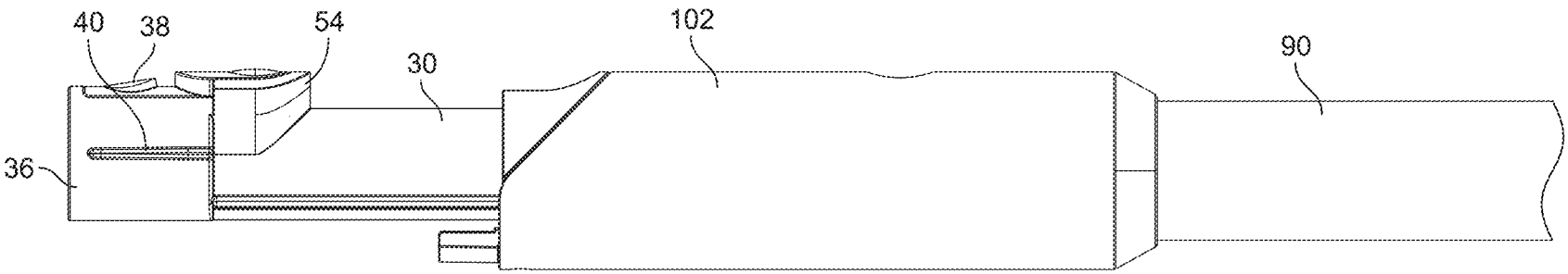
Figure 14C:
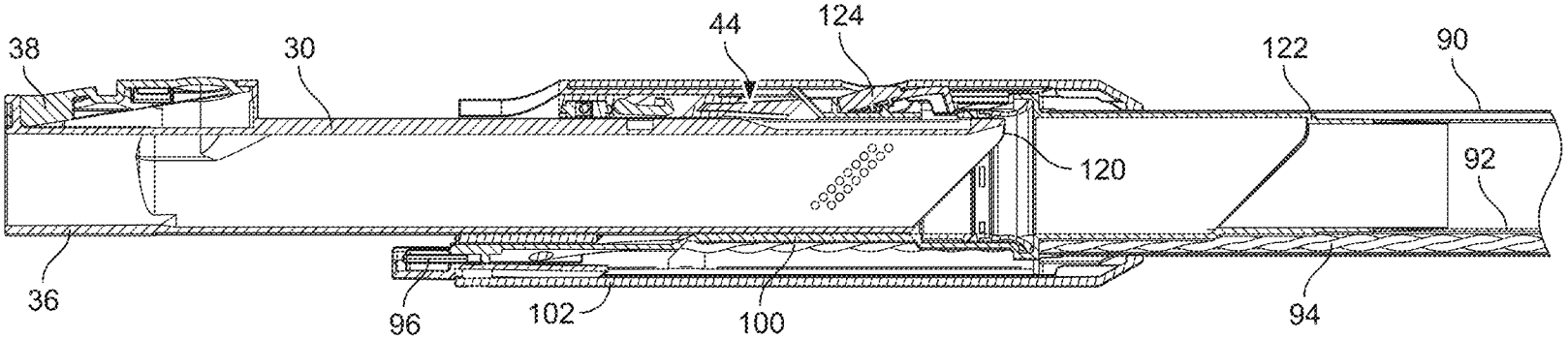
Figure 14D:
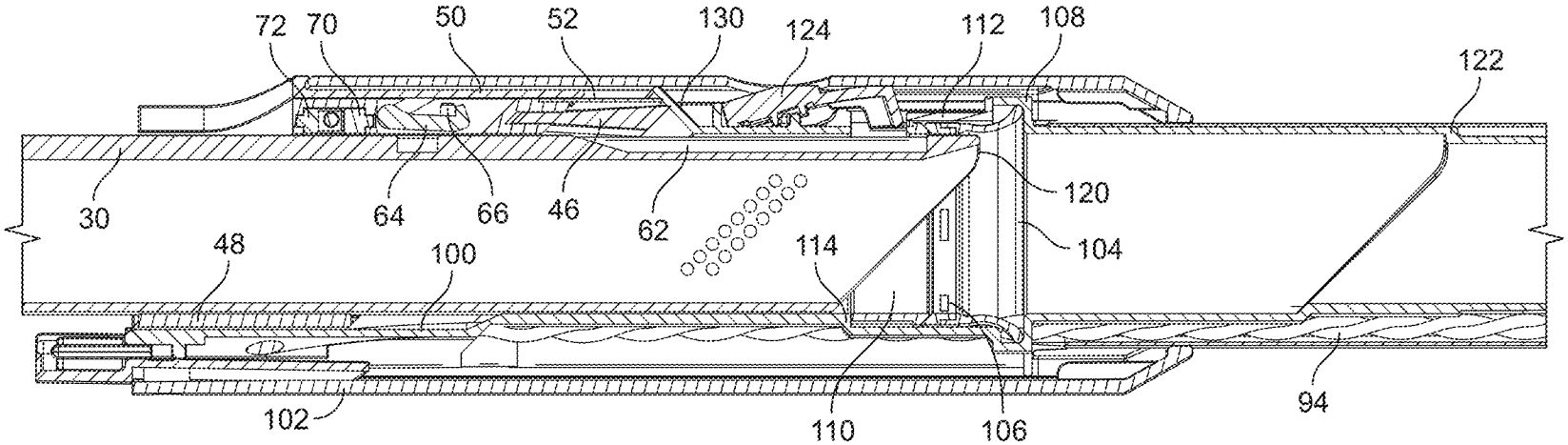
Figure 17A:
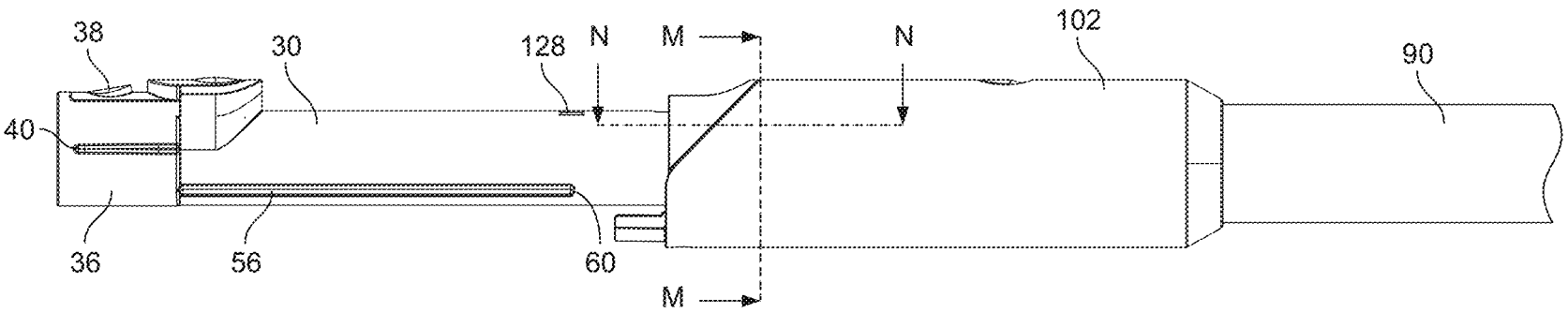
FIG. 17(*a*) is a side view of a portion of the wand assembly as illustrated in FIG. 15(*a*), FIG. 17(*b*) is a sectional view taken along line M-M in FIG. 17(*a*), and FIG. 17(*c*) is a sectional view taken along line N-N in FIG. 17(*a*)
Figure 17B:
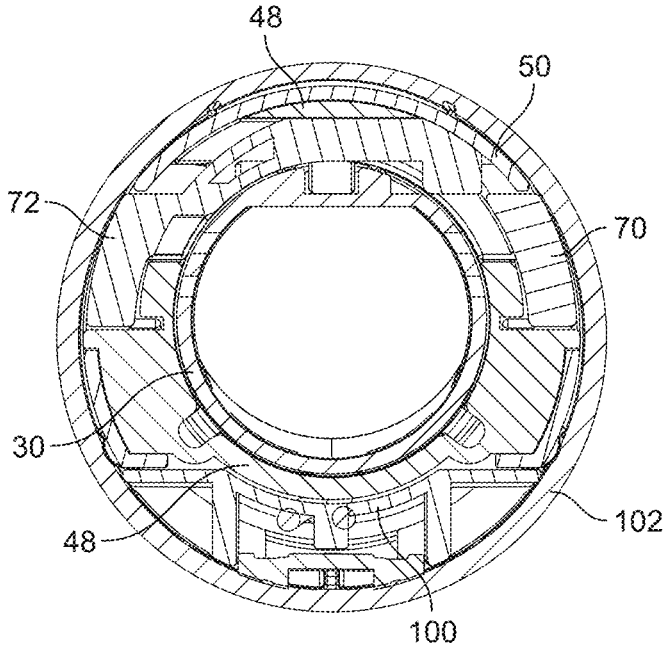
Figure 17C:
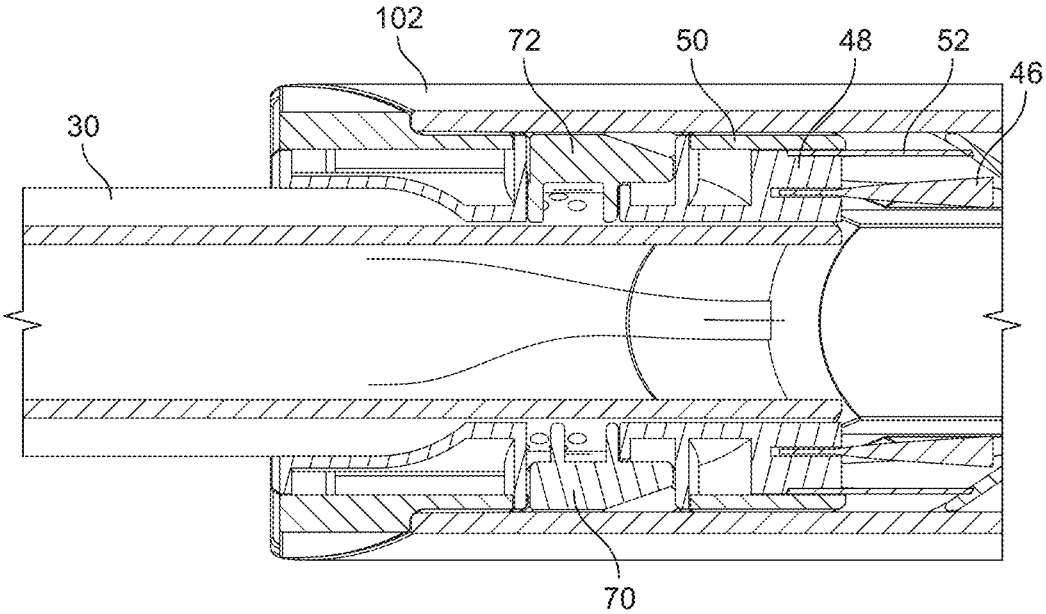

To disconnect the second part 26 from the first part 12, the user depresses the catch 124 to move the end portions 126 of the catch 124 out from the recesses 128, and, simultaneously, pulls the second part 26 from the first part 12. With particular reference to FIGS. 17(*b*) and 17(*c*), the neck cover 102 is shaped to form an interference fit with the brush cover 50. The mechanical interaction between the brush cover 50 and the neck 98 serves to retain the brush section 44 in a static position within the neck 98 as the crevice nozzle 30 starts to be withdrawn from the second part 26, as illustrated in FIGS. 13(*a*) to 14(*d*). As a result, the withdrawal of the first part 12 from the second part 26 effects movement of the brush section 44 relative to the crevice nozzle 30 towards its deployed position.

Figure 15A:
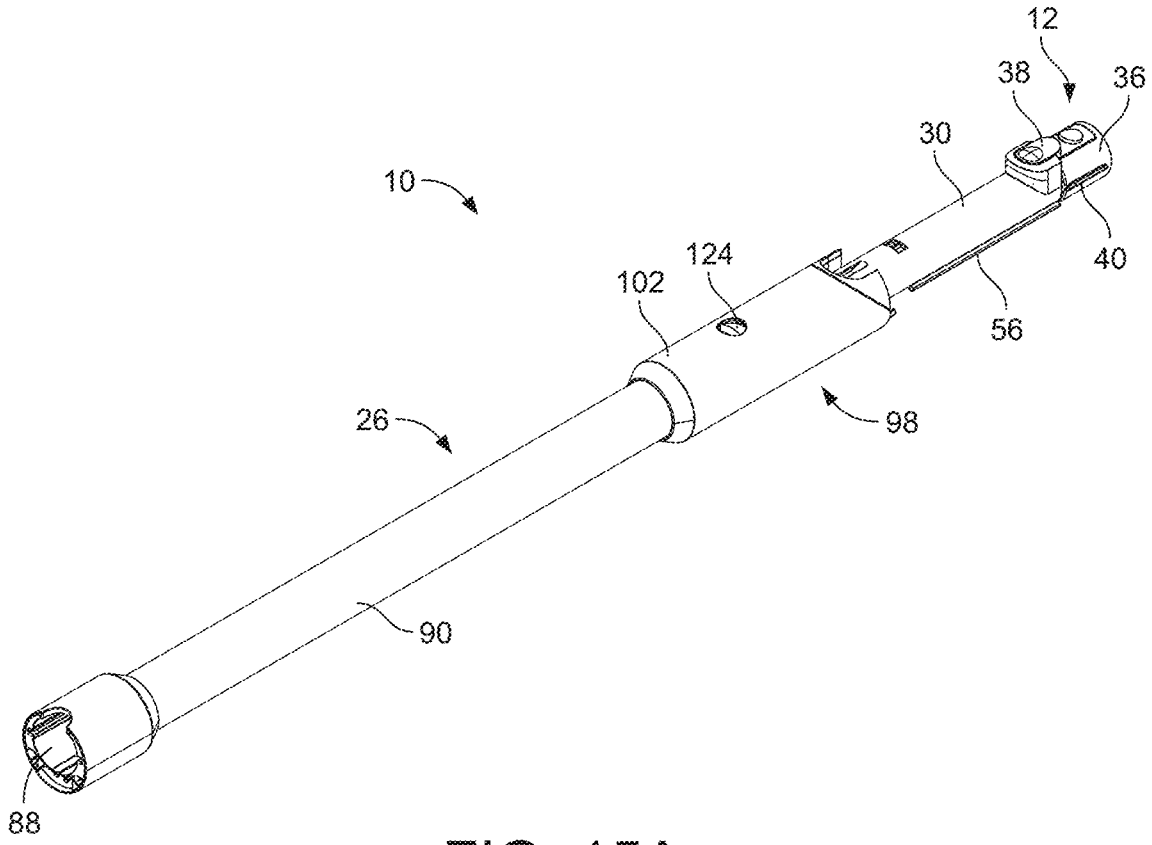
FIG. 15(*a*) is a perspective view of the wand assembly in which the first part of the wand assembly is almost fully withdrawn from the second part of the wand assembly, and FIG. 15(*b*) is a rear view of the assembly as illustrated in FIG. 15(*a*)
Figure 15B:
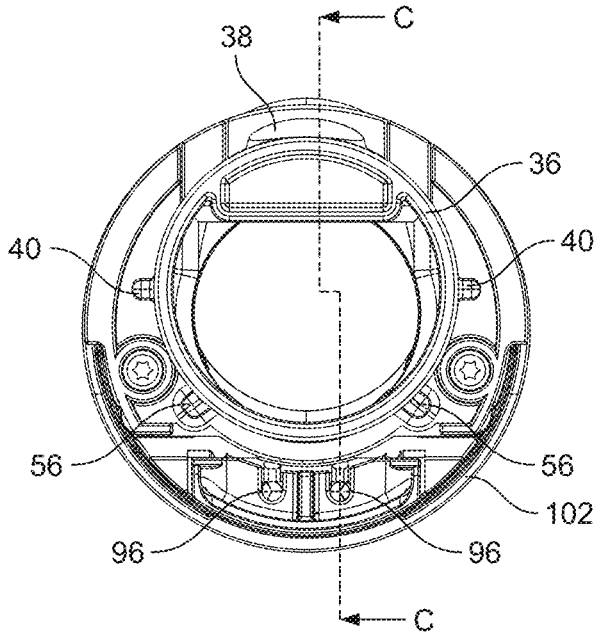
Figure 16A:
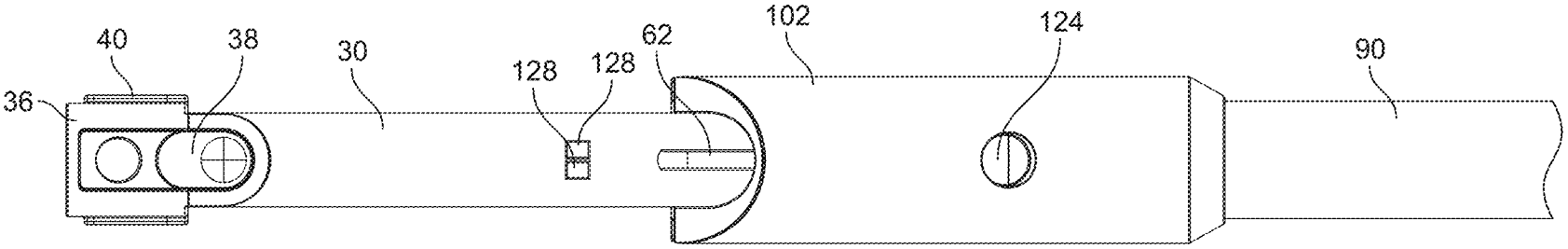
FIG. 16(*a*) is a top view of a portion of the wand assembly as illustrated in FIG. 15(*a*), FIG. 16(*b*) is a sectional view of a portion of the wand assembly, taken along line C-C in FIG. 15(*b*), and FIG. 16(*c*) is a close up of part of FIG. 16(*b*)
Figure 16B:
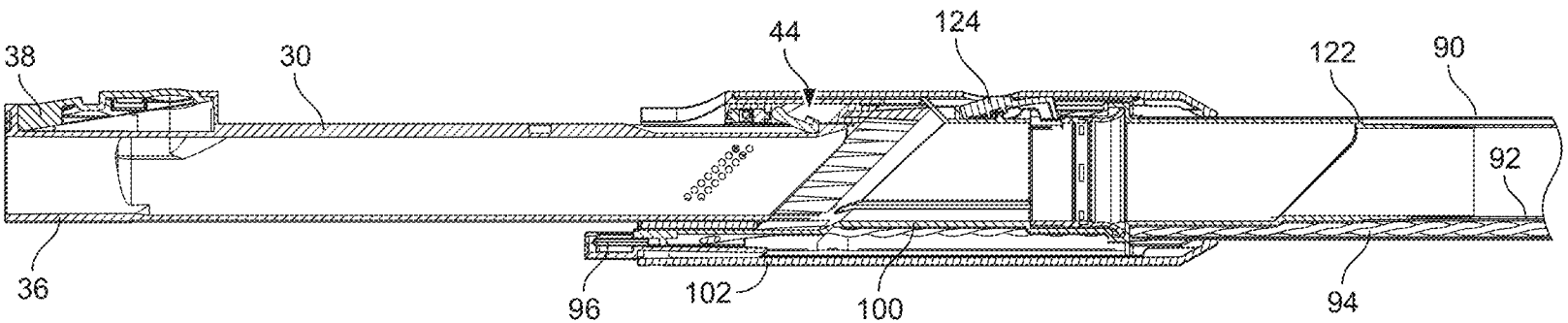
Figure 16C:
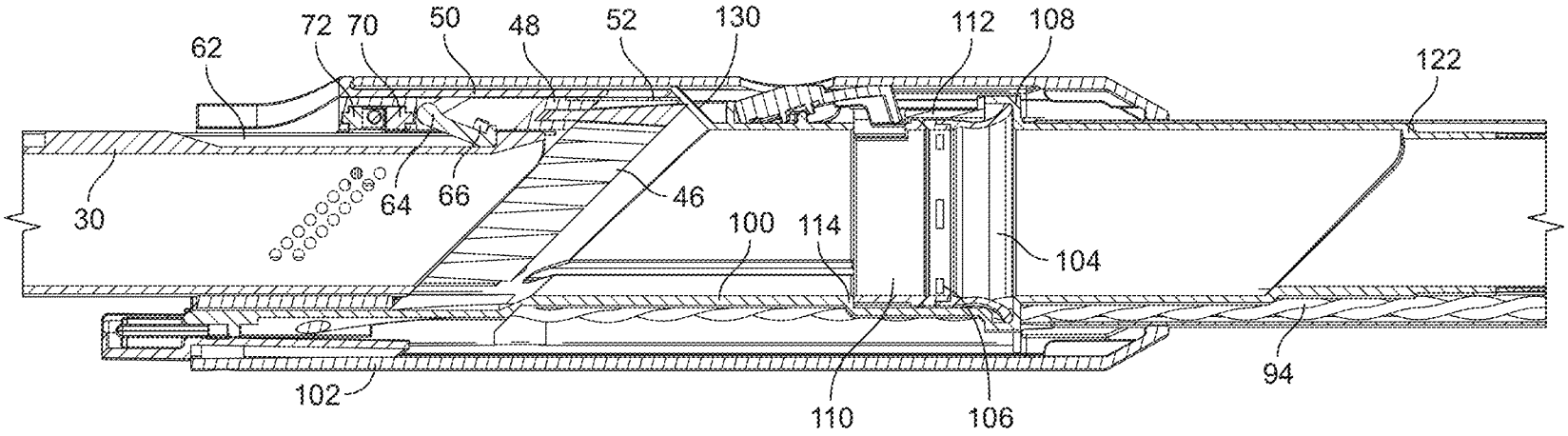

FIGS. 15(*a*) to 17(*c*) illustrate the wand assembly 10 with the first part 12 almost fully withdrawn from the second part 26. In the configuration illustrated in these figures, the crevice nozzle 30 has been withdrawn from the second part 26 to such an extent that the brush section 44 has moved relative to the crevice nozzle 30 to its deployed position. As shown most clearly in FIG. 16(*c*), with the brush section 44 in its deployed position the pawl 64 is located at the end of the channel 62 proximate to the end of the crevice nozzle 30, and is urged against the end of the channel 62 by the spring 66. This inhibits movement of the brush section 44 beyond its deployed position. Consequently, any further movement of the crevice nozzle 30 out from the second part 26 of the wand assembly 10 will cause the brush section 44 to move with the crevice nozzle 30 relative to the neck 98. As a result, whilst having been first inserted into the second part 26 with the brush section 44 in its retracted position, the first part 12 is subsequently withdrawn from the second part 26 with the brush section 44 in its deployed position.

As the brush section 44 is pulled from the second part 26 of the wand assembly 10, the brush section 44 becomes released from the neck 98. This allows the fingers 70, 72 to move relative to the crevice nozzle 30, under the action of the biasing springs, from the position illustrated in FIG. 17(*b*) to the position illustrated in FIG. 8(*b*). The ends 76 of the fingers 70, 72 enter the recesses 78, 80 to retain the brush section 44 in its deployed position.

The first part 12 may also be inserted into the second part 26 of the wand assembly 10 with the brush section 44 in its deployed position. In this case, as the first part 12 is inserted into the second part 26 the free ends of the bristles 46 and the bristle sleeve 52 engage an inclined wall 130 of the neck body 100 to inhibit movement of the brush section 44 within the neck body 100 beyond the position illustrated in FIGS. 15(*a*) to 17(*c*). As discussed above, in this position the neck 98 forms an interference fit with the brush cover 50, and serves to move the bases 74 of the fingers 70, 72 inwardly to release the brush section 44 from its deployed position. The crevice nozzle 30 may then be further inserted into the second part 26 of the wand assembly 10, as illustrated in FIGS. 13(*a*) to 14(*d*), whilst the brush section 44 remains stationary within the neck 98 in the position illustrated in FIGS. 15(*a*) to 17(*c*). With further pushing of the crevice nozzle 30 into the second part 26, the catch 124 enters the recesses 128 of the crevice nozzle 30 to connect the first part 12 to the second part 26, as illustrated in FIGS. 11(*a*) to 12(*d*).

Figure 18A:
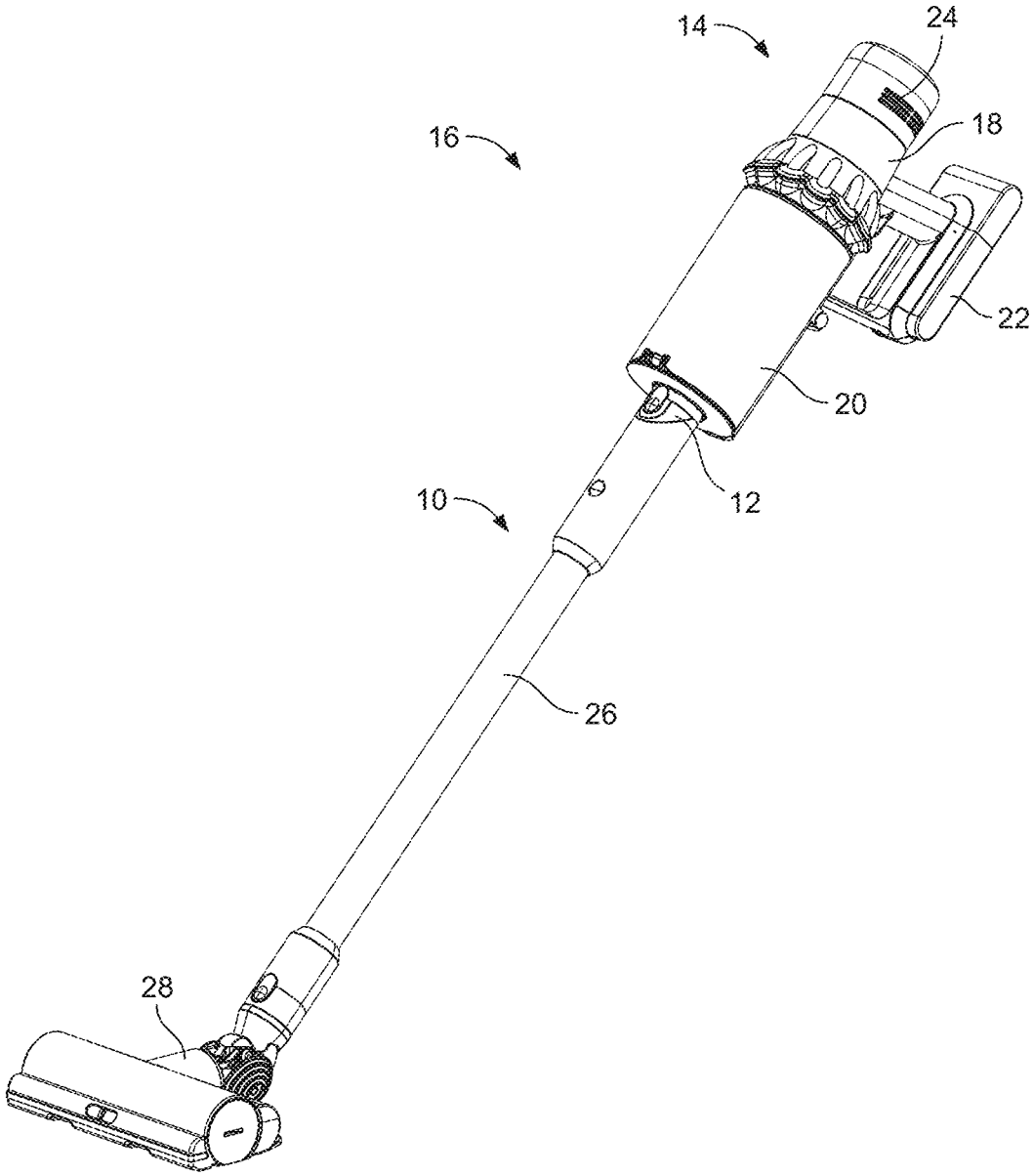
FIG. 18(*a*) is a perspective view illustrating the vacuum cleaning appliance of FIG. 1 in a floor cleaning mode, FIG. 18(*b*) is a similar view to FIG. 18(*a*) but with the first part partially withdrawn from the second part, and FIG. 18(*c*) is a similar view to FIG. 18(*a*) but with the first part almost fully withdrawn from the second part.
Figure 18B:
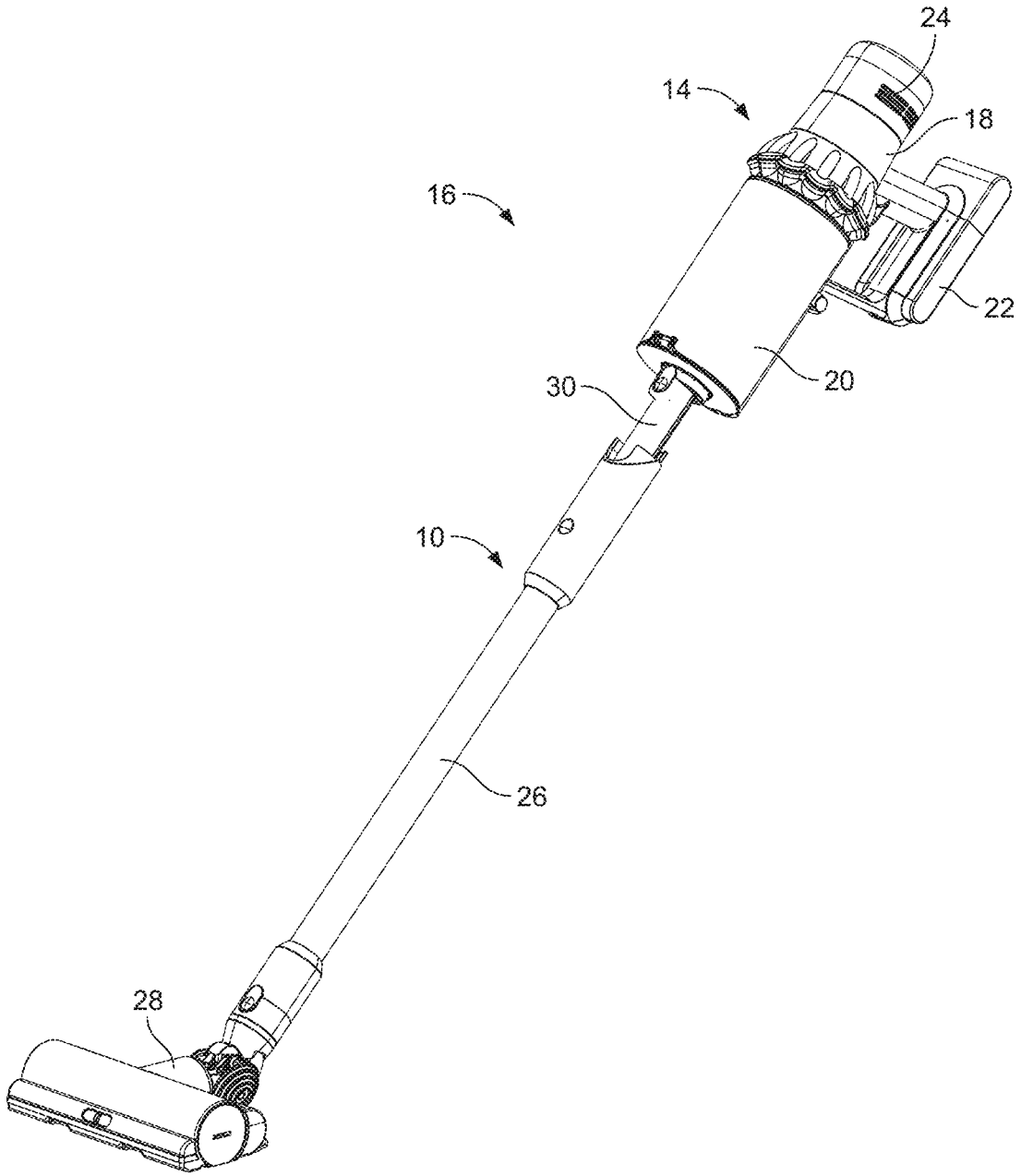
Figure 18C:
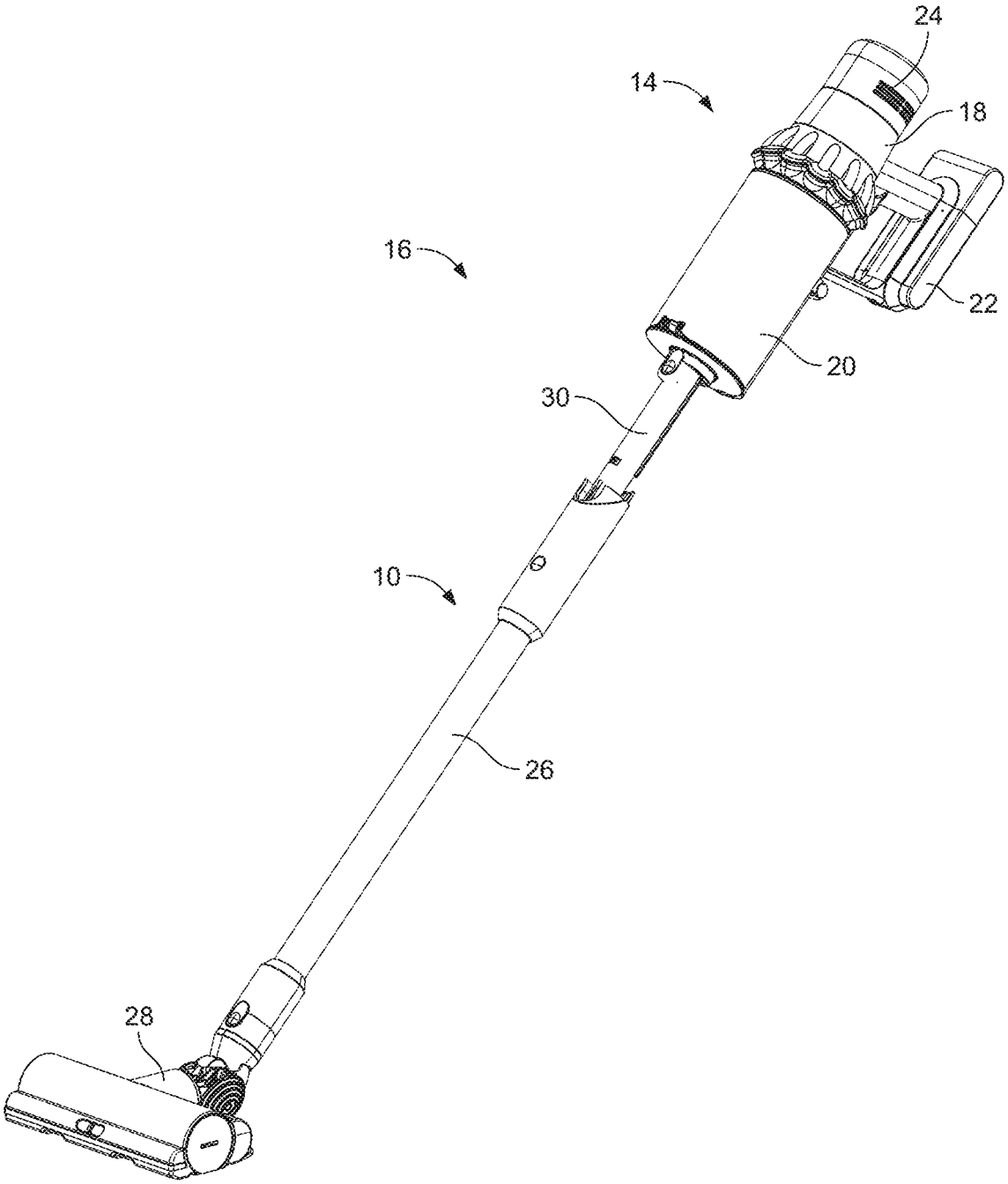

In use, the assembled wand assembly 10 may be connected to the main body 14 of a vacuum cleaning appliance 16 and to a floor tool 28, as illustrated in FIG. 18(*a*), for floor cleaning. The first part 12 of the wand assembly 10 is connected to the main body 14, the second part 26 of the wand assembly 26 is connected to the first part 12, and a floor tool 28 is connected to the second part 26. An airflow generated by the suction source 18 of the appliance 16 enters the appliance 16 through the floor tool, and passes through the wand assembly 10 to the main body 14 of the appliance 16. Within the wand assembly 10, the airflow passes through the inner tube 92 and is conveyed into the crevice nozzle 30 by the neck body 100. The seal 104 inhibits the leakage of air from between the crevice nozzle 30 and the neck body 100. The airflow flows through the crevice nozzle 30 to enter the main body 14 of the appliance 10.

Figure 19:
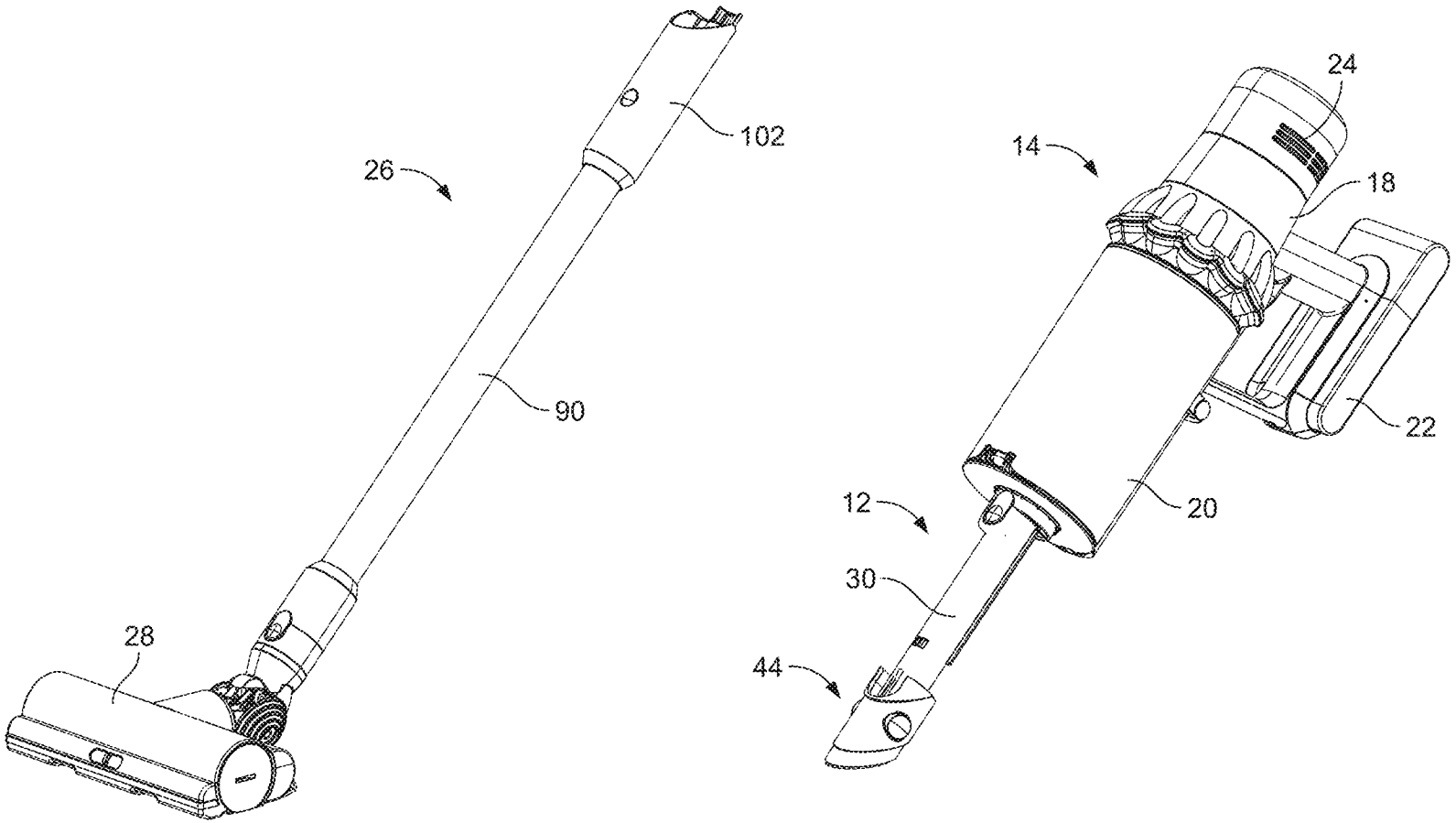
FIG. 19 is a perspective view of the vacuum cleaning appliance following disconnection of the first part from the second part, and with the appliance in a handheld mode.
Figure 20B:
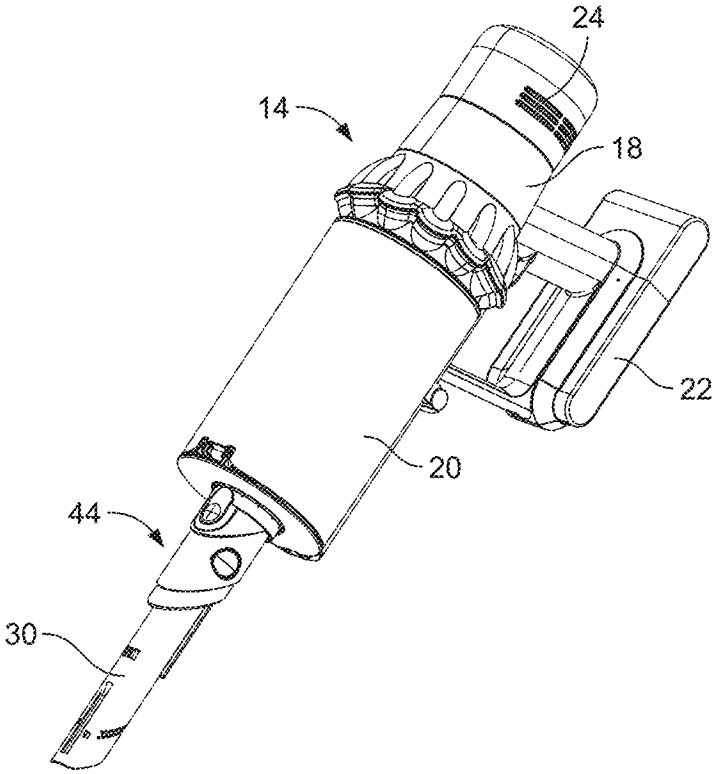
FIG. 20(*a*) is a perspective view of the vacuum cleaning appliance in a handheld mode and with the brush section midway between the retracted position and deployed position, and FIG. 20(*b*) is a perspective view of the vacuum cleaning appliance in a handheld mode and with the brush section in a retracted position.
Figure 20A:
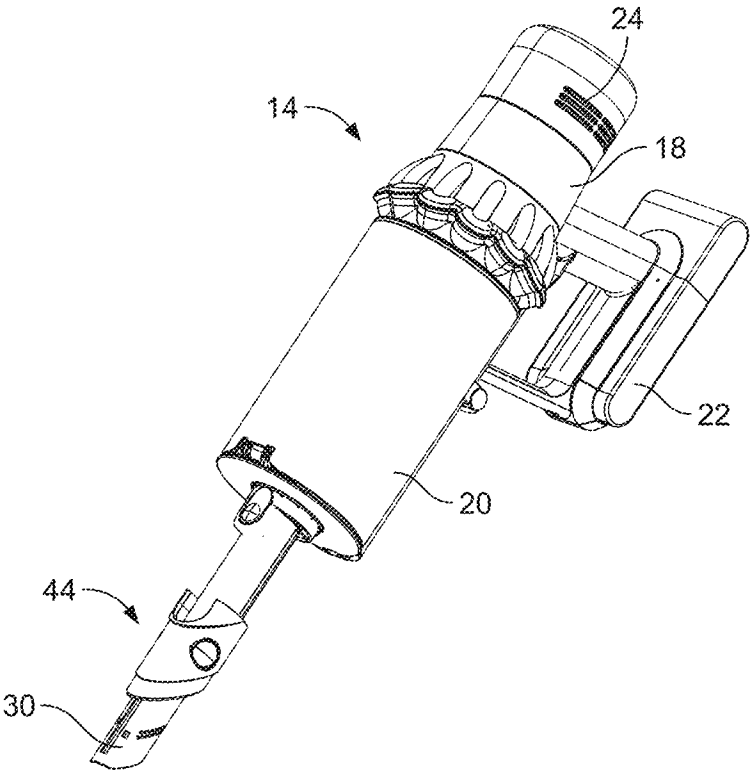

To use the appliance 16 in a handheld mode of operation for cleaning furniture and the like, the user depresses catch 124 to disengage the end portions 126 of the catch 124 from the recesses 128 to release the second part 26 from the first part 12. Simultaneously, the user pulls the second part 26 away from the first part 12, as shown sequentially in FIGS. 18(*b*) and 18(*c*), until the second part 26 has become detached from the first part, as illustrated in FIG. 19 (the user may release the catch 124 as soon as the end portions 126 of the catch 124 have become axially spaced from the recesses 128). This enables the appliance 16 to be used in a handheld mode to clean items above a floor surface. With the brush section 44 in its deployed position, the appliance 16 may be used in a brush mode, in which the bristles 46 agitate dust from the surfaces of furniture, ornaments or the like to become entrained within the airflow entering the first part 12 of the wand assembly 10. To move the brush section 44 to its retracted position, as illustrated sequentially in FIGS. 20(*a*) and 20(*b*), the user squeezes together the bases 74 of the fingers 70, 72 and pushes the brush section 44 along the crevice nozzle 30 to its retracted position.

The invention claimed is:

1. An attachment for a vacuum cleaning appliance, the attachment comprising:

a first part comprising a crevice nozzle, a brush section which is moveable relative to the crevice nozzle between a retracted position and a deployed position, and a first connector for releasably connecting the first part to a body of the appliance; and a second part comprising a suction inlet and a second connector for releasably connecting the second part to the first part, and wherein the second part is arranged to be push-fitted over the first part so that the crevice nozzle and the brush section are stored within the second part when the second part is connected to the first part.

2. The attachment according to claim 1, wherein the brush section comprises bristles and a bristle sleeve which extends about the bristles.

3. The attachment according to claim 2, wherein the bristle sleeve is formed from a resiliently deformable material.

4. The attachment according to claim 2, wherein the bristle sleeve has a free end, and tips of the bristles protrude beyond the free end of the bristle sleeve.

5. The attachment according to claim 4, wherein no more than 20% of a length of the bristles protrudes beyond the free end of the bristle sleeve.

6. The attachment according to claim 4, wherein no more than 10% of a length of the bristles protrudes beyond the free end of the bristle sleeve.

7. The attachment according to claim 1, wherein the second part is arranged to store the crevice nozzle and the brush section with the brush section disposed in its retracted position.

8. The attachment according to claim 7, wherein the second part is arranged to move the brush section towards its deployed position as the second part is pulled away from the first part.

9. The attachment according to claim 8, wherein the second part comprises a neck located at one end of the second part, the suction inlet being located at another end of the second part, the neck being arranged to receive at least the brush section of the first part.

10. The attachment according to claim 9, wherein the neck comprises a relatively wide internal section for receiving the brush section, and a relatively narrow internal section, located upstream from the relatively wide internal section, for receiving a front section of the crevice nozzle.

11. The attachment according to claim 9, wherein the neck forms an interference fit with the brush section when the brush section is stored in the second part.

12. The attachment according to claim 8, wherein the first part further comprises a retention mechanism which is releasable to retain the brush section in its deployed position, and wherein the second part is arranged to release the retention mechanism as the second part is pulled away from the first part.

13. The attachment according to claim 1, wherein the first part further includes a first guide mechanism for guiding movement of the brush section away from its retracted position, and a second guide mechanism for guiding movement of the brush section into its deployed position.

14. The attachment according to claim 13, wherein the second guide mechanism comprises a pawl located on the brush section and a channel located on the crevice nozzle which the pawl enters as the brush section moves towards its deployed position.

15. The attachment according to claim 14, wherein the first guide mechanism comprises a plurality of rails located on the crevice nozzle, and a plurality of channels located on the brush section which receive the rails as the brush section moves towards its retracted position, and wherein the channel is axially spaced from the rails.

16. The attachment according to claim 15, wherein the second part further comprises a seal, and wherein the crevice nozzle comprises an annular mating surface for engaging the seal.

17. The attachment according to claim 16, wherein the mating surface is defined by an area of an external surface of the crevice nozzle which is located between the rails of the first guide mechanism and the channel of the second guide mechanism.

18. The attachment according to claim 17, wherein the seal comprises a first end which is retained by a neck, and a second end which is connected to a seal carriage which is moveable relative to the neck, and wherein as the second part is pushed over the first part, ends of the rails urge the carriage to move towards the first end of the seal, deforming the seal so as to urge it into contact with the mating surf ace of the crevice nozzle.

19. The attachment according to claim 1, wherein the second part further comprises a wand for attachment to an auxiliary suction tool.

20. A wand assembly for a vacuum cleaning appliance, the assembly comprising:

a first part comprising a crevice nozzle, a brush section which is moveable relative to the crevice nozzle between a retracted position and a deployed position, and a first connector for releasably connecting the first part to a body of the appliance; and a second part comprising a wand and a second connector for releasably connecting the second part to the body of the appliance, and wherein the second part is arranged to be push-fitted over the first part so that the crevice nozzle and the brush section are stored within the second part when the second part is connected to the body of the appliance.

* * * * *